US009127385B2

(12) United States Patent
Suzuki et al.

(10) Patent No.: US 9,127,385 B2
(45) Date of Patent: Sep. 8, 2015

(54) SEWING MACHINE, NON-TRANSITORY COMPUTER-READABLE MEDIUM, AND SEWING MACHINE SYSTEM

(71) Applicants: Satomi Suzuki, Nagoya (JP); Noriharu Tashiro, Nagoya (JP); Hirotsugu Takahata, Owariasahi (JP)

(72) Inventors: Satomi Suzuki, Nagoya (JP); Noriharu Tashiro, Nagoya (JP); Hirotsugu Takahata, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/164,820

(22) Filed: Jan. 27, 2014

(65) Prior Publication Data

US 2014/0230707 A1 Aug. 21, 2014

(30) Foreign Application Priority Data

Feb. 15, 2013 (JP) ..... 2013-027496

(51) Int. Cl.
*D05B 19/12* (2006.01)
*D05C 5/00* (2006.01)

(52) U.S. Cl.
CPC . *D05B 19/12* (2013.01); *D05C 5/00* (2013.01)

(58) Field of Classification Search
CPC ..... D05B 19/02; D05B 19/08; D05B 19/085; D05B 19/10; D05B 19/12; D05B 19/105; D05C 9/02; D05C 9/04; D05C 9/06; D05C 5/00
USPC ..... 700/135–138; 112/475.02, 475.18
See application file for complete search history.

(56) References Cited

U.S. PATENT DOCUMENTS

| | | | | |
|---|---|---|---|---|
| 5,880,963 | A * | 3/1999 | Futamura | 700/138 |
| 5,911,182 | A * | 6/1999 | Uyama et al. | 112/102.5 |
| 5,943,972 | A | 8/1999 | Hirata | |
| 6,167,822 | B1 | 1/2001 | Miyasako et al. | |
| 6,256,551 | B1 * | 7/2001 | Muto | 700/138 |
| 7,155,302 | B2 | 12/2006 | Muto et al. | |

(Continued)

FOREIGN PATENT DOCUMENTS

| | | |
|---|---|---|
| JP | A-2009-172123 | 8/2009 |
| JP | A-2012-068746 | 4/2012 |

OTHER PUBLICATIONS

Office Action issued in U.S. Appl. No. 14/164,798 dated Apr. 25, 2014.

(Continued)

*Primary Examiner* — Danny Worrell
(74) *Attorney, Agent, or Firm* — Oliff PLC

(57) ABSTRACT

A sewing machine includes an embroidery frame moving portion, a sewing portion, a communication portion, a processor, and a memory. The memory is configured to store computer-readable instructions that cause the processor to perform the steps of specifying an embroidery pattern and a size of the embroidery pattern, outputting the size of the embroidery pattern through the communication portion to a device provided with an image capture portion, acquiring positioning data through the communication portion, setting at least one of a position and the angle of a embroidery pattern on a sewing workpiece based on the positioning data, acquiring embroidery data, and causing the embroidery frame moving portion and the sewing portion to form stitches that make up the embroidery pattern on the sewing workpiece based on the embroidery data. The positioning data have been computed by the device based on image data and output to from the device.

8 Claims, 12 Drawing Sheets

(56) References Cited

U.S. PATENT DOCUMENTS

| | | | | |
|---|---|---|---|---|
| 7,392,755 | B2 * | 7/2008 | Kato et al. | 112/102.5 |
| 7,675,418 | B2 * | 3/2010 | Agarwal et al. | 340/572.1 |
| 8,061,286 | B2 * | 11/2011 | Hirata et al. | 112/470.01 |
| 8,091,493 | B2 * | 1/2012 | Tokura | 112/470.01 |
| 8,196,535 | B2 * | 6/2012 | Tokura | 112/470.01 |
| 8,245,219 | B2 * | 8/2012 | Agarwal et al. | 717/172 |
| 8,301,292 | B2 * | 10/2012 | Tokura | 700/138 |
| 8,463,420 | B2 * | 6/2013 | Tokura | 700/137 |
| 8,527,083 | B2 * | 9/2013 | Tokura | 700/138 |
| 8,539,892 | B2 * | 9/2013 | Tokura | 112/102.5 |
| 8,539,893 | B2 * | 9/2013 | Tokura | 112/103 |
| 8,594,829 | B2 * | 11/2013 | Tokura | 700/136 |
| 8,612,046 | B2 * | 12/2013 | Tokura | 700/138 |
| 8,720,353 | B2 * | 5/2014 | Nakamura et al. | 112/470.06 |
| 8,738,173 | B2 * | 5/2014 | Tokura | 700/138 |
| 8,763,541 | B2 * | 7/2014 | Tokura | 112/102.5 |
| 8,869,721 | B2 * | 10/2014 | Suzuki et al. | 112/102.5 |
| 2009/0188413 | A1 | 7/2009 | Hirata et al. | |

OTHER PUBLICATIONS

U.S. Appl. No. 14/164,916, filed Jan. 27, 2014 in the name of Suzuki et al.

U.S. Appl. No. 14/164,798, filed Jan. 27, 2014 in the name of Suzuki et al.

* cited by examiner

| | | | | |
|---|---|---|---|---|
| SCHEMATIC DIAGRAM OF FIRST FRAME | |  |  |  |
| ID | | 1 | 2 | 3 |
| RELATIVE POSITIONS | P1 | (X11, Y11) | (X21, Y21) | (X31, Y31) |
| | P2 | (X12, Y12) | (X22, Y22) | (X32, Y32) |
| | P3 | (X13, Y13) | (X23, Y23) | (X33, Y33) |
| | P4 | (X14, Y14) | (X24, Y24) | (X34, Y34) |
| SEWING AREA SIZE | | X15, Y15 | X25, Y25 | X35, Y35 |
| IMAGE CAPTURE POSITIONS | FRONT | (X18, Y18) | (X28, Y28) | (X38, Y38) |
| | LEFT | (X19, Y19) | (X29, Y29) | (X39, Y39) |
| | LEFT FRONT | (X10, Y10) | (X20, Y20) | (X30, Y30) |

SEWING MACHINE, NON-TRANSITORY COMPUTER-READABLE MEDIUM, AND SEWING MACHINE SYSTEM

CROSS-REFERENCE TO RELATED APPLICATION

This application claims priority to Japanese Patent Application No. 2013-027496, filed Feb. 15, 2013, the content of which is hereby incorporated herein by reference in its entirety.

BACKGROUND

The present disclosure relates to a sewing machine that is configured to form stitches that represent an embroidery pattern, a non-transitory computer-readable medium, and a sewing machine system.

A sewing machine is known that in configured to easily set, on a sewing workpiece that is clamped in an embroidery frame, positions and angles where stitches that make up an embroidery pattern will be formed. For example, a sewing machine is known that is provided with an image capture device. The sewing machine may cause the image capture device to capture an image of a mark that a user has affixed to the sewing workpiece in a designated position. Based on the captured image of the mark, the sewing machine may automatically set, on the sewing workpiece, the positions and the angles for the stitches that make up the embroidery pattern.

SUMMARY

A camera is installed as the image capture device in the sewing machine that is described above. The configuration of the sewing machine is therefore complex, and the sewing machine is comparatively expensive.

Various embodiments of the broad principles derived herein provide a sewing machine, a non-transitory computer-readable medium and a sewing machine system that make it possible to easily set, on a sewing workpiece, at least one of a position and an angle where a stitch will be formed that makes up a portion of an embroidery pattern, without making the configuration of the sewing machine complicated.

Various embodiments herein provide a sewing machine that includes an embroidery frame moving portion, a sewing portion, a communication portion, a processor, and a memory. The embroidery frame moving portion is configured to move an embroidery frame in a movement direction. The sewing portion is configured to form a stitch in a sewing workpiece that is clamped in the embroidery frame. The communication portion is configured to perform transmission and receiving of data to and from an external device. The memory is configured to store computer-readable instructions. When executed by the processor, the computer-readable instructions cause the processor to perform the steps of specifying an embroidery pattern to be formed in the sewing workpiece that is clamped in the embroidery frame, and a size of the embroidery pattern, outputting the size of the embroidery pattern through the communication portion to a device that is provided with an image capture portion, acquiring positioning data through the communication portion, setting at least one of the position and the angle of the embroidery pattern on the sewing workpiece, based on the positioning data, acquiring embroidery data, and causing the embroidery frame moving portion and the sewing portion to form the stitches that make up the embroidery pattern on the sewing workpiece, based on the embroidery data. The positioning data are data that the device has computed based on image data for an image that has been captured of a range that includes at least one reference mark and at least one indicator mark. The positioning data indicate at least one of a position and an angle of the at least one indicator mark in relation to the at least one reference mark. The at least one reference mark is provided on the embroidery frame. The at least one indicator mark is positioned in an area inside the embroidery frame on the sewing workpiece that is clamped in the embroidery frame. The positioning data are output from the device to the sewing machine in response to determining by the device that the embroidery pattern can be positioned in a sewing area in a case where at least one of a position and an angle of the embroidery pattern on the sewing workpiece is set based on the size of the embroidery pattern and on the positioning data. The sewing area is an area that is set inside the embroidery frame. The embroidery data are data for forming stitches that make up the embroidery pattern at at least one of the position and the angle of the embroidery pattern on the sewing workpiece that has been set.

Various embodiments also provide a non-transitory computer-readable medium that stores computer-readable instructions. When executed by a processor of a sewing machine that includes an embroidery frame moving portion that is configured to move an embroidery frame in a moving direction, a sewing portion that is configured to form a stitch in a sewing workpiece that is clamped in the embroidery frame, and a communication portion that is configured to perform transmission and receiving of data to and from an external device, the computer-readable instructions cause the processor to perform the steps of specifying an embroidery pattern to be formed in the sewing workpiece that is clamped in the embroidery frame, and a size of the embroidery pattern, outputting the size of the embroidery pattern through the communication portion to a device that is provided with an image capture portion, acquiring positioning data through the communication portion, setting at least one of the position and the angle of the embroidery pattern on the sewing workpiece, based on the positioning data, acquiring embroidery data, and causing the embroidery frame moving portion and the sewing portion to form the stitches that make up the embroidery pattern on the sewing workpiece, based on the embroidery data. The positioning data are data that the device has computed based on image data for an image that has been captured of a range that includes at least one reference mark and at least one indicator mark. The positioning data indicate at least one of a position and an angle of the at least one indicator mark in relation to the at least one reference mark. The at least one reference mark is provided on the embroidery frame. The at least one indicator mark is positioned in an area inside the embroidery frame on the sewing workpiece that is clamped in the embroidery frame. The positioning data are output from the device to the sewing machine in response to determining by the device that the embroidery pattern can be positioned in a sewing area in a case where at least one of a position and an angle of the embroidery pattern on the sewing workpiece is set based on the size of the embroidery pattern and on the positioning data. The sewing area is an area that is set inside the embroidery frame. The embroidery data are data for forming stitches that make up the embroidery pattern at at least one of the position and the angle of the embroidery pattern on the sewing workpiece that has been set.

Various embodiments further provide a sewing machine system that includes a sewing machine, an embroidery frame, and a device. The sewing machine includes an embroidery frame moving portion, a sewing portion, a first communication portion, a first processor, and a first memory. The embroidery frame moving portion is configured to be removably mounted with the embroidery frame and to move the embroidery frame in a movement direction. The sewing portion is configured to form a stitch in a sewing workpiece that is clamped in the embroidery frame. The sewing portion includes a needle bar. The first communication portion is configured to perform transmission and receiving of data to and from an external device. The first memory is configured to store computer-readable instructions. When executed by the first processor, the computer-readable instructions cause the first processor to perform the steps of specifying an embroidery pattern to be formed in the sewing workpiece that is clamped in the embroidery frame, and a size of the embroidery pattern, outputting the size of the embroidery pattern to the device through the first communication portion, acquiring, through the first communication portion, positioning data that has been output from the device, setting at least one of the position and the angle of the embroidery pattern on the sewing workpiece, based on the positioning data, acquiring embroidery data, causing the embroidery frame moving portion and the sewing portion to form the stitches that make up the embroidery pattern on the sewing workpiece, based on the embroidery data. The positioning data are data that the device has computed based on image data for an image that has been captured of a range that includes at least one reference mark and at least one indicator mark. The positioning data indicate at least one of a position and an angle of the at least one indicator mark in relation to the at least one reference mark. The at least one reference mark is provided on the embroidery frame. The at least one indicator mark is positioned in an area inside the embroidery frame on the sewing workpiece that is clamped in the embroidery frame. The embroidery data are data for forming stitches that make up the embroidery pattern at at least one of the position and the angle of the embroidery pattern on the sewing workpiece that has been set. The embroidery frame includes a mounting portion and a clamping portion. The mounting portion is configured to be mounted on and removed from the embroidery frame moving portion. The clamping portion includes a first frame and a second frame. The first frame and the second frame are configured to clamp the sewing workpiece. The clamping portion has the at least one reference mark that is disposed at a visible position on a side of the clamping portion that is opposite the needle bar in a state in which the sewing workpiece is clamped. The device includes an image capture portion, a second communication portion, a second processor, and a second memory. The image capture portion is configured to create image data. The second communication portion is configured to perform transmission and receiving of data to and from an external device. The second memory is configured to store computer-readable instructions. When executed by the second processor, the computer-readable instructions cause the second processor to perform the steps of causing the image capture portion to capture the image of the range that includes the at least one reference mark and the at least one indicator mark, and to create the image data for the image, acquiring, through the second communication portion, the size of the embroidery pattern that has been output from the sewing machine, computing the positioning data based on the image data, determining whether the embroidery pattern can be positioned in a sewing area in a case where at least one of the position and the angle of the embroidery pattern on the sewing workpiece is set based on the positioning data and the size of the embroidery pattern, and outputting the positioning data to the sewing machine through the second communication portion, in response to determining that the embroidery pattern can be positioned in the sewing area. The sewing area is an area that is set inside the embroidery frame.

BRIEF DESCRIPTION OF THE DRAWINGS

Embodiments will be described below in detail with reference to the accompanying drawings in which.

DETAILED DESCRIPTION

Figure 1:
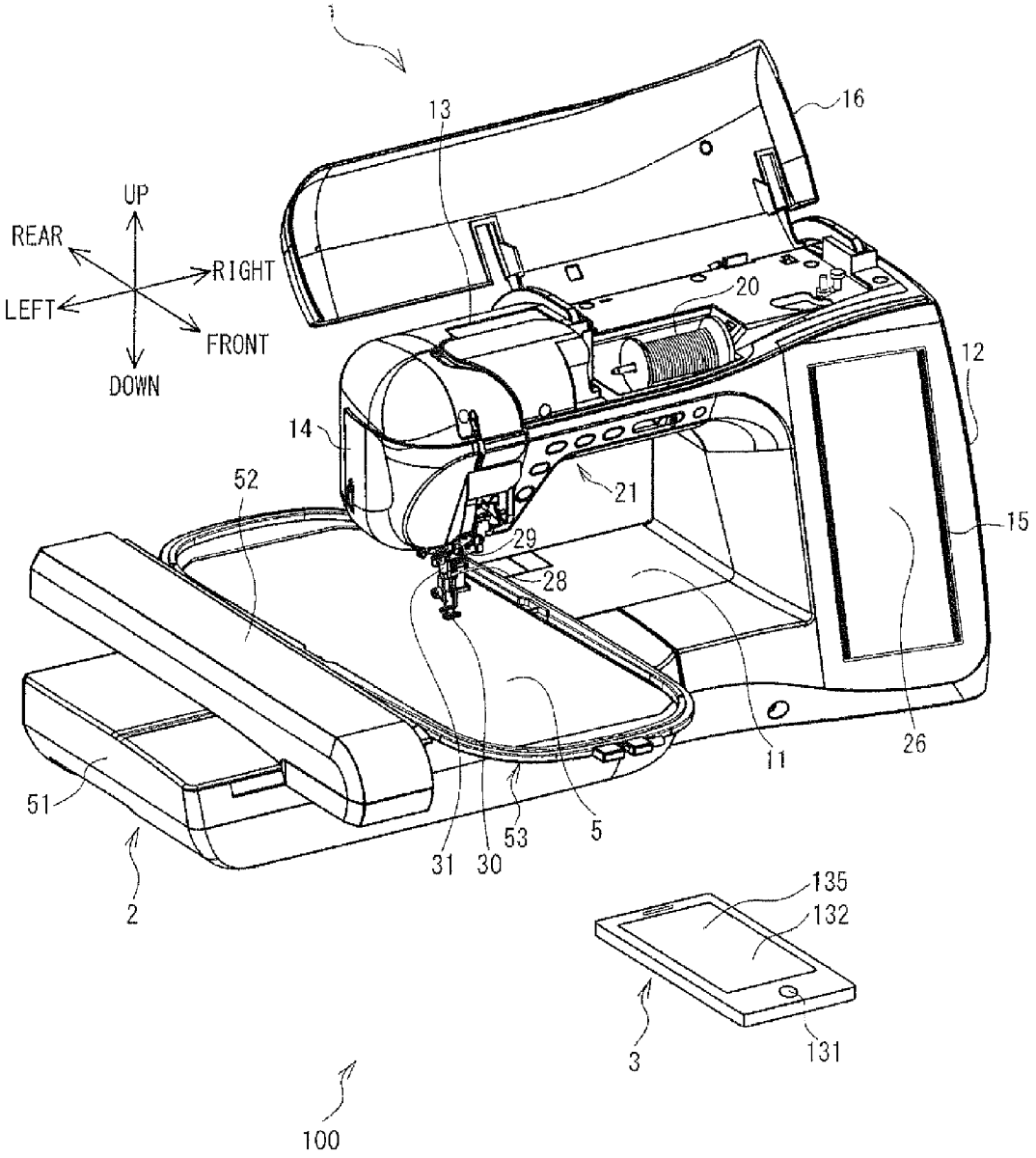
FIG. 1 is an oblique view of a sewing machine system that includes a sewing machine, a portable terminal, and an embroidery frame.

Hereinafter, an embodiment will be explained with reference to the drawings. First, a sewing machine system 100 will be explained with reference to FIGS. 1 to 5. As shown in FIG. 1, the sewing machine system 100 mainly includes a sewing machine 1, a portable terminal 3, and an embroidery frame 53. Each of the sewing machine 1 and the portable terminal 3 is configured to be connectable to a network 9 (refer to FIG. 4). The network 9 may be a public network, for example. Hereinafter, physical configurations of the sewing machine 1, the portable terminal 3, and the embroidery frame 53 will be explained in that order. The top side, the bottom side, the lower left side, the upper right side, the upper left side, and the lower right side in FIG. 1 respectively correspond to the top side, the bottom side, the left side, the right side, the rear side, and the front side of the sewing machine 1 and the portable terminal 3. The top side, the bottom side, the left side, the right side, the rear side, and the front side in FIG. 2 respectively correspond to the rear side, the front side, the left side, the right side, the bottom side, and the top side of the embroidery frame 53.

The sewing machine 1 is configured to sew an embroidery pattern. As shown in FIG. 1, the sewing machine 1 includes a bed 11, a pillar 12, and an arm 13. The bed 11 is a base portion of the sewing machine 1, and extends in the left-right direction. The pillar 12 extends upward from the right end of the bed 11. The aim 13 extends to the left from the upper end of the pillar 12, such that the arm 13 is opposite the bed 11. The left end portion of the arm 13 is a head 14.

A needle plate (not shown in the drawings) is provided in the top face of the bed 11. A feed dog (not shown in the drawings), a feed mechanism 85 (refer to FIG. 4), a feed motor 80 (refer to FIG. 4), and a shuttle mechanism (not shown in the drawings) are provided underneath the needle plate, that is, inside the bed 11. The feed dog may be driven by the feed mechanism 85 and is configured to feed a sewing workpiece in a specified feed direction (one of toward the front and toward the rear of the sewing machine 1). The sewing workpiece may be a work cloth, for example. The feed mechanism 85 is a mechanism that is configured to drive the feed dog in the up-down direction and in the front-rear direction. A bobbin around which a lower thread is wound can be accommodated in the shuttle mechanism. The shuttle mechanism is a mechanism that is configured to form a stitch in the sewing workpiece by operating in coordination with a sewing needle 28 that is mounted on the lower end of a needle bar 29, which will be described later. The feed motor 80 is a pulse motor for driving the feed mechanism 85.

A well-known embroidery device 2 that is used during embroidery sewing can be mounted on the bed 11. When the embroidery device 2 is mounted on the sewing machine 1, the embroidery device 2 and the sewing machine 1 are electrically connected. When the embroidery device 2 and the sewing machine 1 are electrically connected, the embroidery device 2 can move a sewing workpiece 5 that is held by the embroidery frame 53. The embroidery device 2 includes a body 51 and a carriage 52.

The carriage 52 is provided on the top side of the body 51. The carriage 52 has a three-dimensional rectangular shape, with its longer axis extending in the front-rear direction. The carriage 52 includes a frame holder (not shown in the drawings), a Y axis moving mechanism 88 (refer to FIG. 4), and a Y axis motor 83 (refer to FIG. 4). The frame holder is configured such that an embroidery frame can be mounted on and removed from the frame holder. A plurality of types of embroidery frames are available that differ from one another in at least one of size and shape. Hereinafter, when the plurality of the different types of the embroidery frames are referenced collectively, they will be called the embroidery frames 53, and when one of the plurality of the different types of the embroidery frames is referenced without being specifically identified, it will be called the embroidery frame 53. The configurations of the embroidery frames 53 and the types of the embroidery frames 53 will be described later. The frame holder is provided on the right side face of the carriage 52. The sewing workpiece 5 that is held by the embroidery frame 53 is disposed on the top side of the bed 11, below the needle bar 29 and a presser foot 30. The Y axis moving mechanism 88 is configured to move the frame holder in the front-rear direction (in a Y axis direction). The moving of the frame holder in the front-rear direction causes the embroidery frame 53 to move the sewing workpiece 5 in the front-rear direction. The Y axis motor 83 is configured to drive the Y axis moving mechanism 88. A CPU 61 of the sewing machine 1 (refer to FIG. 4) is configured to control the Y axis motor 83 in accordance with coordinate data that will be described later.

An X axis moving mechanism 87 (refer to FIG. 4) and an X axis motor 82 (refer to FIG. 4) are provided in the interior of the body 51. The X axis moving mechanism 87 is configured to move the carriage 52 in the left-right direction (in an X axis direction). The moving of the carriage 52 in the left-right direction causes the embroidery frame 53 to move the sewing workpiece 5 in the left-right direction. The X axis motor 82 is configured to drive the X axis moving mechanism 87. The CPU 61 of the sewing machine 1 is configured to control the X axis motor 82 in accordance with the coordinate data that will be described later.

A liquid crystal display (hereinafter called the LCD) 15 is provided on the front face of the pillar 12. Images that include various items such as commands, illustrations, setting values, messages, and the like may be displayed on the LCD 15. A touch panel 26 that is configured to detect a position that is pressed is provided on the front side of the LCD 15. When the user performs a pressing operation on the touch panel 26 using a finger or a stylus pen, the position that is pressed is detected by the touch panel 26. The item that has been selected within the image is then recognized based on the pressed position that has been detected. Hereinafter, the operation in which the touch panel 26 is pressed by the user will be called a panel operation. The user can use a panel operation to select a pattern to be sewn or a command to be executed.

A connector (not shown in the drawings) is provided in the right side face of the pillar 12. The sewing machine 1 can be connected to an external device through the connector. Examples of the external device include a personal computer (PC), an image capture device, and a portable terminal, for example.

A cover 16 that can be opened and closed is provided in an upper portion of the arm 13. FIG. 1 shows the cover 16 in an opened state. A thread spool 20 may be accommodated underneath the cover 16, that is approximately in the center of the interior of the arm 13. An upper thread (not shown in the drawings) that is wound around the thread spool 20 may be supplied from the thread spool 20, through a thread guide portion (not shown in the drawings) that is provided in the head 14, to the sewing needle 28 that is mounted on the needle bar 29. A plurality of operation switches 21 that include a start/stop switch are provided in a lower portion of the front face of the arm 13.

A presser mechanism 90 (refer to FIG. 4), a needle bar up-and-down moving mechanism 84 (refer to FIG. 4), a needle bar swinging mechanism 86 (refer to FIG. 4), a swinging motor 81 (refer to FIG. 4), and the like are provided inside the head 14. The presser mechanism 90 is a mechanism that is configured to drive a presser bar 31, using a presser motor 89 (refer to FIG. 4) as a drive source. The needle bar up-and-down moving mechanism 84 is a mechanism that is configured to drive the needle bar 29 up and down in accordance with the rotation of a drive shaft (not shown in the drawings). The needle bar up-and-down moving mechanism 84 may be driven by a sewing machine motor 79 (refer to FIG. 4). The needle bar 29 and the presser bar 31 extend downward from the bottom edge of the head 14. The sewing needle 28 can be mounted on and removed from the lower end of the needle bar 29. The presser foot 30 can be mounted on and removed from the lower end of the presser bar 31. The presser foot 30 can press against the sewing workpiece 5 from above such that the sewing workpiece 5 can be fed. The needle bar swinging mechanism 86 is a mechanism that is configured to swing the needle bar 29 in a direction (the left-right direction) that is orthogonal to the direction (the front-rear direction) in which the sewing workpiece 5 is fed by the feed dog. The swinging motor 81 is a pulse motor that is configured to drive the needle bar swinging mechanism 86.

In the sewing machine 1, when a stitch is formed using the embroidery device 2, the embroidery frame 53 is moved by the Y axis moving mechanism 88 and the X axis moving mechanism 87 to a needle drop point that is indicated in terms of an embroidery coordinate system that is specific to the sewing machine 1. The embroidery coordinate system is the coordinate system for the X axis motor 82 and the Y axis motor 83 that are configured to move the carriage 52. In the present embodiment, the embroidery coordinate system is set as will now be described. The left-right direction of the sewing machine 1 is the X axis direction, and the direction from left to right is the positive direction on the X axis. The front-rear direction of the sewing machine 1 is the Y axis direction, and the direction from front to rear is the positive direction on the Y axis. The needle drop point is the point where the sewing needle 28, which is positioned directly above a needle hole 36 (refer to FIG. 5), pierces the sewing workpiece 5 when the needle bar 29 is moved downward from above the sewing workpiece 5. The stitches that make up the pattern on the sewing workpiece 5 may be formed by the driving of the shuttle mechanism (not shown in the drawings) and the needle bar 29 on which the sewing needle 28 is mounted, in concert with the moving of the embroidery frame 53. The X axis motor 82, the Y axis motor 83, the needle bar 29, and the like may be controlled by the CPU 61, which is built into the sewing machine 1 and will be described later, based on the coordinate data, which will be described later. When an ordinary utility stitch pattern that is not an embroidery pattern is sewn, the sewing may be performed in a state in which the embroidery device 2 has been removed from the bed 11, and the sewing workpiece 5 is moved by the feed dog (not shown in the drawings).

The physical configuration of the portable terminal 3 will be explained with reference to FIG. 1. The portable terminal 3 is a well-known multi-functional mobile telephone (that is, a so-called smartphone). On the top face, the portable terminal 3 includes an operation switch 131, a touch panel 132, and a display portion 135. The operation switch 131 may be used for inputting various types of commands to the portable terminal 3. Images that include various items such as commands, illustrations, setting values, messages, and the like may be displayed on the display portion 135. The touch panel 132 is provided on the front side of the display portion 135 and is configured to detect a position that is pressed. When the user performs a pressing operation on the touch panel 132 using a finger or a stylus pen, the position that is pressed is detected by the touch panel 132. The item that has been selected within the image is then recognized based on the pressed position that has been detected. The portable terminal 3 includes a camera 136 (refer to FIG. 4) on its bottom face. The camera 136 may be a well-known complementary metal oxide semiconductor (CMOS) image sensor, for example.

Figure 2:
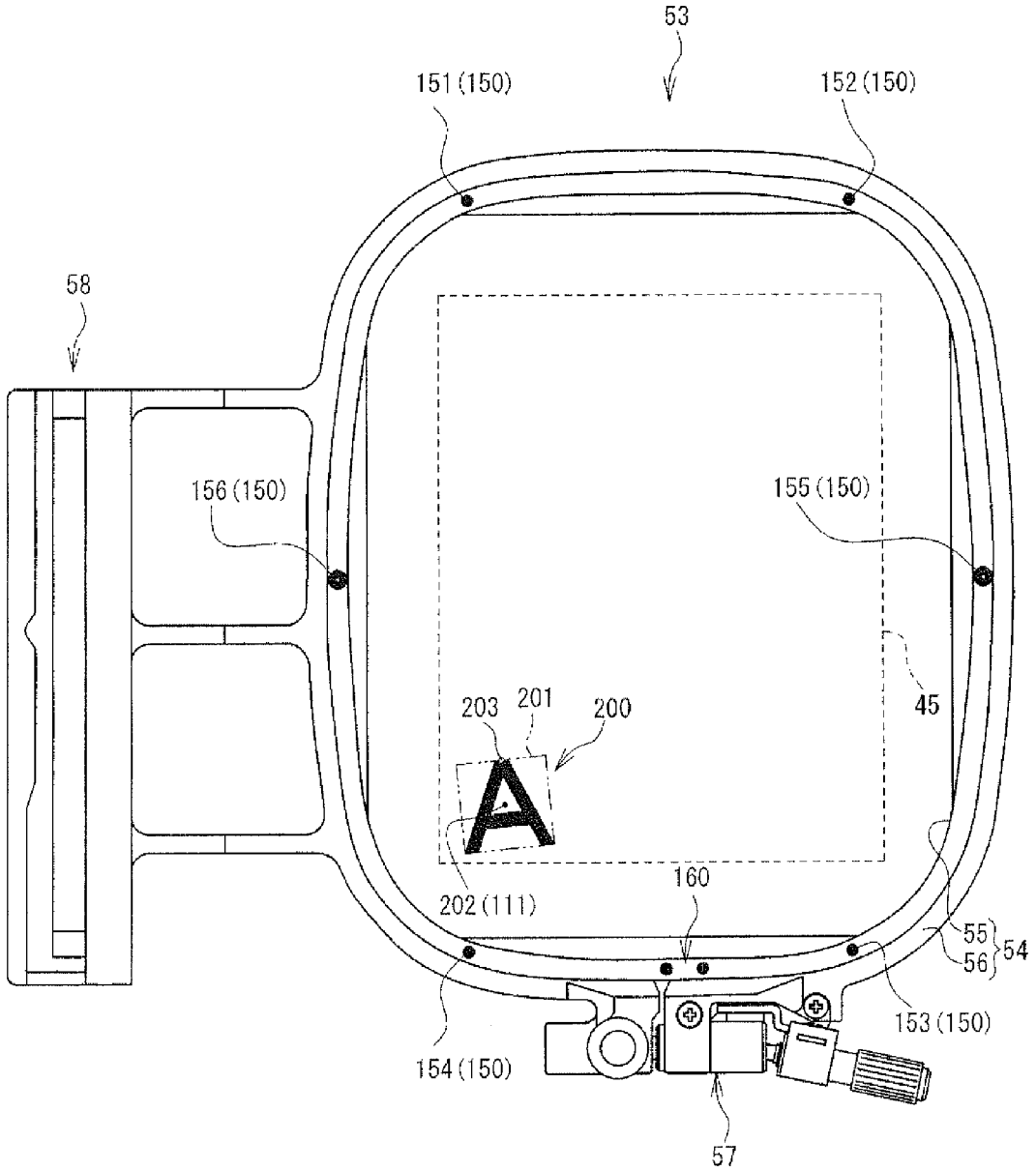
FIG. 2 is a plan view of the embroidery frame.

The physical configuration of embroidery frame 53 will be explained with reference to FIG. 2. As shown in FIG. 2, the embroidery frame 53 includes a mounting portion 58 and a clamping portion 54. The mounting portion 58 is configured to be mounted on and removed from the frame holder (not shown in the drawings) of the embroidery device 2 that is mounted on the sewing machine 1. The clamping portion 54 includes a first frame 55 and a second frame 56. The first frame 55 and the second frame 56 are configured to clamp the sewing workpiece 5. The first frame 55 and the second frame 56 are each a rectangular frame-shaped member whose longer axis extends in the front-rear direction and whose corners are rounded. The inner circumferential shape of the second frame 56 is substantially identical to the outer circumferential shape of the first frame 55. The first frame 55 is configured to be fitted inside of and removed from the second frame 56. A parting portion 57 that is divided in a central portion of its longer dimension (the left-right direction) is provided on the front side of the second frame 56. A tightening mechanism that tightens the second frame 56 in relation to the first frame 55 is provided in the parting portion 57. The sewing workpiece 5 may be clamped between the first frame 55 and the second frame 56 and may be held in a taut state by the tightening mechanism.

In a state in which the clamping portion 54 has clamped the sewing workpiece 5 and the embroidery frame 53 is mounted in the frame holder of the embroidery device 2, the top face of the first frame 55 can be visually recognized on the side that faces the needle bar 29 of the sewing machine 1. Reference marks 151 to 154 are respectively disposed at the left rear, the right rear, the right front, and the left front of top face of the first frame 55. Reference marks 155 and 156 are respectively disposed on the right side and the left side of the top face of the first frame 55, approximately midway between the front edge and the rear edge of the first frame 55. Hereinafter, when the plurality of the reference marks 151 to 156 are referenced collectively, they will be called the reference marks 150, and when one of the plurality of the reference marks 151 to 156 is referenced without being specifically identified, it will be called the reference mark 150. The reference marks 150 may be used as references when at least one of a position and an angle of an indicator mark 110 that will be described later is computed based on image data for an image of the embroidery frame 53 that is captured in a state in which the sewing workpiece 5 is clamped in the embroidery frame 53. Each of the reference marks 151 to 154 is a mark that is expressed in the form of a single round, black pattern (hereinafter simply called the round, black pattern). It is preferable for the positioning of the reference marks 151 to 154 to be determined by taking into consideration an area in which the indicator mark 110 is possibly disposed, that is, a sewing area 45. The sewing area 45 is an area that is set inside the first frame 55 and within which a stitch can be formed by the sewing machine 1. The sewing area 45 differs according to the type of the embroidery frame 53. In the present embodiment, the reference marks 151 to 154 are disposed close to four corners of the sewing area 45, respectively. Each of the reference marks 155 and 156 is a circular pattern whose diameter is slightly larger than the diameter of the reference marks 151 to 154. The positions of the reference marks 155 and 156 are set by taking into consideration an image capture range in a case where an image of the entire area inside the embroidery frame 53 cannot be captured, as in a case where the image is captured in a state in which the embroidery frame 53 is mounted on the embroidery device 2, for example. In the present embodiment, the positions of the reference marks 155 and 156 are set, as described above, by taking into consideration the case where the image is captured in a state in which the embroidery frame 53 is mounted on the embroidery device 2. The colors, sizes, and shapes of the reference marks 150 are set such that the contrast with the color of the first frame 55 will be clear.

Figure 3:
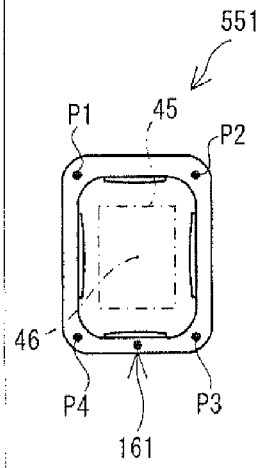
FIG. 3 is an explanatory figure that shows correspondence relationships among schematic diagrams of first frames, which show three types of the embroidery frames whose sizes differ, identification information (IDs) for identifying the types of the embroidery frames, relative positions of characteristic points that are included in reference marks, sizes of sewing areas, and image capture positions.
Figure 3:
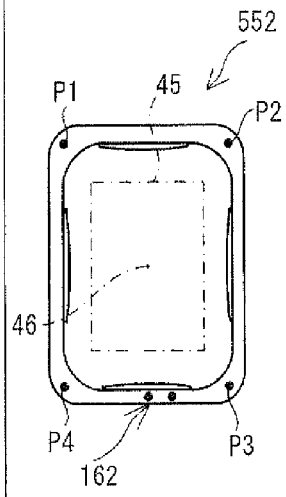
Figure 3:
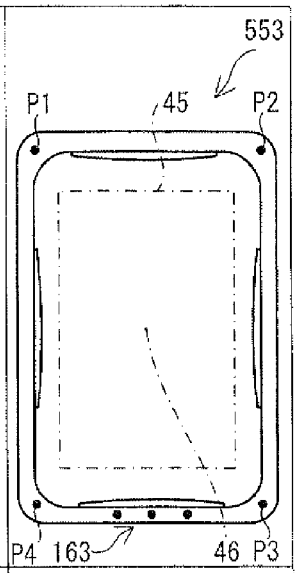

A type mark 160 is disposed on the front side of the top face of the first frame 55. The type mark 160 is a mark that indicates the type of the embroidery frame 53 and the orientation of the embroidery frame 53 within a captured image that will be described later. As described previously, selected one of the plurality of types of the embroidery frames 53 that differ from one another in at least one of size and shape can be mounted on the embroidery device 2. In the explanation that follows, a case in which selected one of three types of the embroidery frames 53 that differ in size can be mounted on the embroidery device 2 will be used as an example. FIG. 3 shows schematic drawings of first frames 551, 552, and 553 for three types of the embroidery frames 53. In the present embodiment, the type mark 160 includes at least one round, black pattern. The three types of the first frames 551, 552, and 553 respectively have type marks 161, 162, and 163. Each of the type marks 161, 162, and 163 includes at least one round, black pattern, but the number of the round, black patterns is different from that for the other two. In the present embodiment, identification information (hereinafter called the ID) for identifying the type of the embroidery frame 53 is expressed in the form of the number of the round, black patterns that are included in the type mark 160. In the present embodiment, a larger number that is indicated by the ID indicates that the size of corresponding embroidery frame 53 is larger than the size of an embroidery frame 53 for which the number that is indicated by the ID is smaller.

The type mark 161 of the first frame 551 of the embroidery frame 53 for which the ID is 1 includes one round, black pattern. The type mark 162 of the first frame 552 of the embroidery frame 53 for which the ID is 2 includes two round, black patterns. The type mark 163 of the first frame 553 of the embroidery frame 53 for which the ID is 3 includes three round, black patterns. The type mark 160 may be used in processing that determines the type of the embroidery frame 53 that will be used for the sewing, based on the image data for the image of the embroidery frame 53 that is captured in a state in which the sewing workpiece 5 is clamped in the embroidery frame 53. Hereinafter, when the type marks 161 to 163 are referenced collectively, they will be called the type marks 160, and when one of the type marks 161 to 163 is referenced without being specifically identified, it will be called the type mark 160. Hereinafter, when the first frames 551 to 553 are referenced collectively, they will be called the first frames 55, and when one of the first frames 551 to 553 is referenced without being specifically identified, it will be called the first frame 55. In the present embodiment, the first frame 55 is mounted in the second frame 56, with the side where the type mark 160 is provided being defined as the front side of the embroidery frame 53. In the present embodiment, each of the reference marks 150 and the type marks 160 is printed on the top face of the first frame 55 during the manufacturing of the first frame 55. Therefore, the position of each of the reference marks 150 and the type marks 160 is fixed in relation to the embroidery frame 53.

Figure 4:
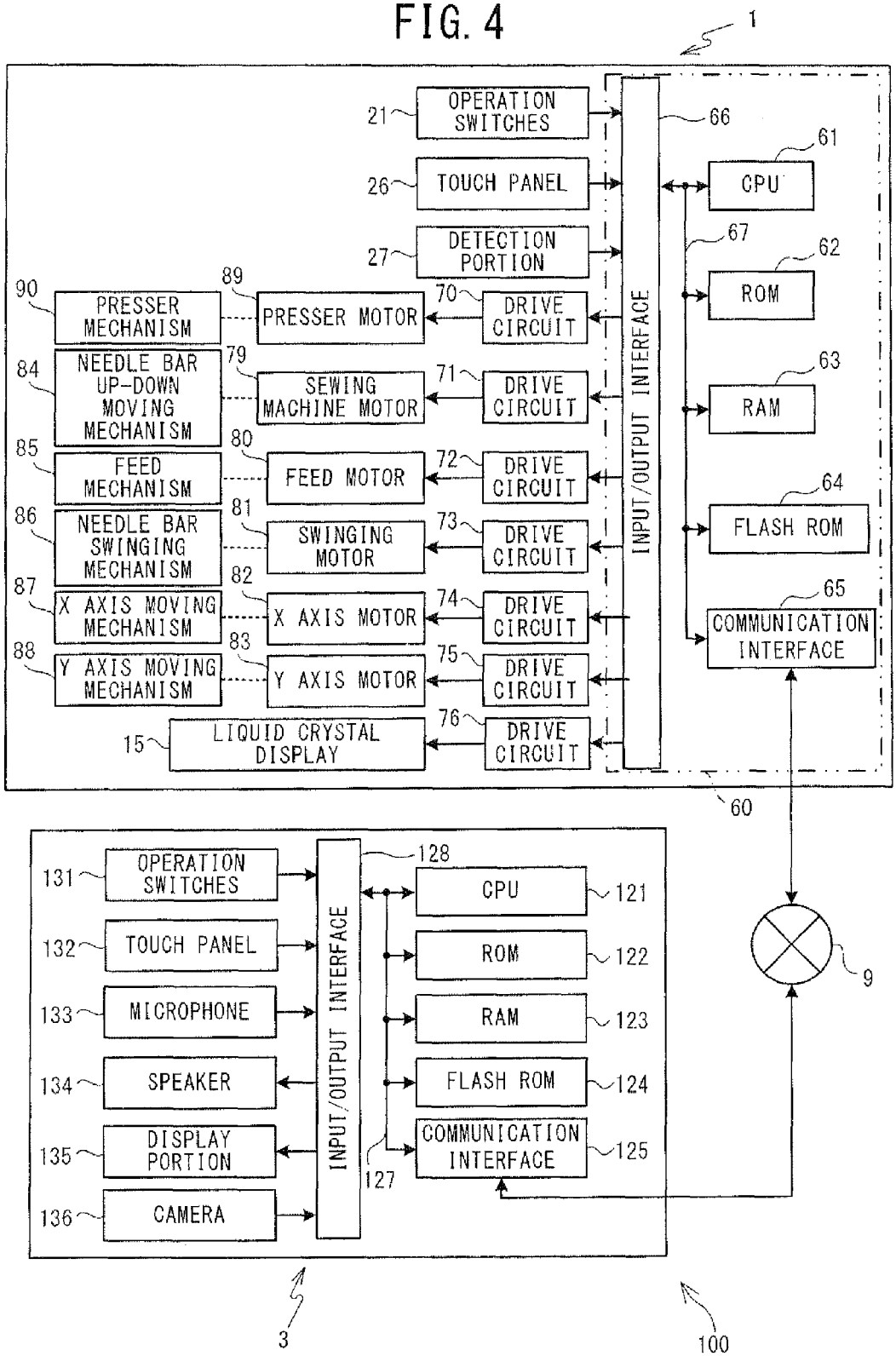
FIG. 4 is block diagram that shows an electrical configuration of the sewing machine system.
Figure 5:
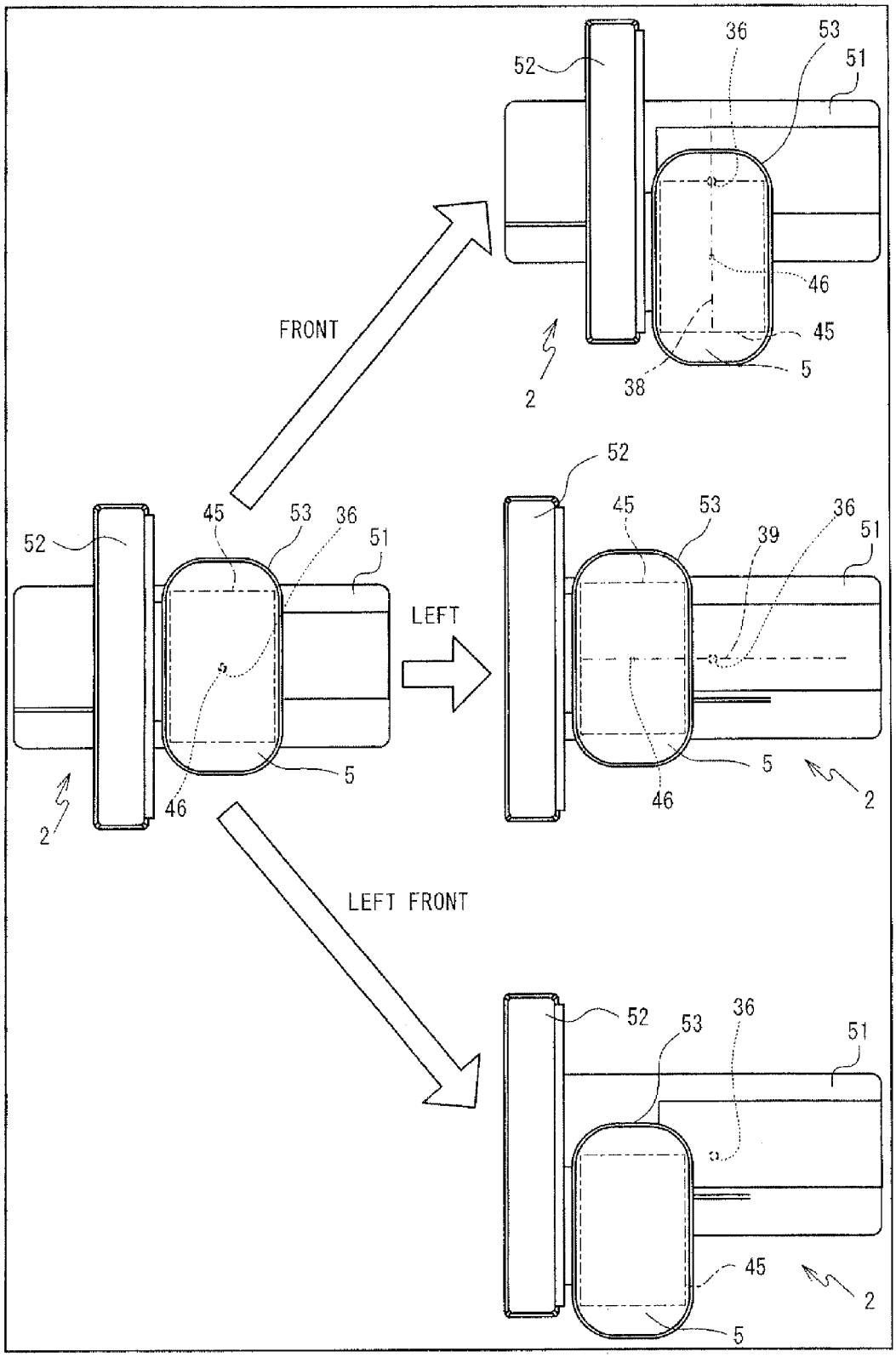
FIG. 5 is a plan view of an embroidery device on which the embroidery frame is mounted, for explaining an initial position of the embroidery frame and three types of the image capture positions.

An electrical configuration of the sewing machine 1 will be explained with reference to FIG. 4. A control portion 60 of the sewing machine 1 includes the CPU 61, a ROM 62, a RAM 63, a flash ROM 64, a communication interface 65, and an input/output interface 66. The CPU 61, the ROM 62, the RAM 63, the flash ROM 64, the communication interface 65, and the input/output interface 66 are electrically connected to one another through a bus 67. Various types of programs, including a program by which the CPU 61 performs second processing that will be described later, are stored in the ROM 62, along with data and the like. An image capture position table, pattern data that will be described later, and various types of parameters for computing positioning data based on the image data and the like are stored in the flash ROM 64. The image capture position table is a portion of the table that is shown in FIG. 3. The image capture position table stores correspondence relationships between the IDs and image capture positions. The image capture positions are positions of the embroidery frame 53 when image capture is performed in a state in which the embroidery frame 53 is mounted on the embroidery device 2. The image capture positions are set such that the indicator mark 110 and the reference marks 153 to 156 will be included in the image capture ranges. In the present embodiment, any one of three types of the image capture positions, that is, front, left, and left front, can be selected. As shown in the left-center portion of FIG. 5, an initial position of the embroidery frame 53 is a position where a center point 46 of the sewing area 45 that is set inside the embroidery frame 53 is congruent with the position of the needle hole 36. In a case where the selected image capture position is the front, as shown in the upper right portion of FIG. 5, the embroidery frame 53 is moved to a position where the embroidery frame 53 is farthest to the front in the front-rear direction and where a straight line 38 that is parallel to the Y axis and that passes through the center point 46 of the sewing area 45 is aligned with the needle hole 36 in the left-right direction. In a case where the selected image capture position is the left, as shown in the right center portion of FIG. 5, the embroidery frame 53 is moved to a position where the embroidery frame 53 is farthest to the left in the left-right direction and where a straight line 39 that is parallel to the X axis and that passes through the center point 46 of the sewing area 45 is aligned with the needle hole 36 in the front-rear direction. In a case where the selected image capture position is the left front, as shown in the lower right portion of FIG. 5, the embroidery frame 53 is moved to a position where the embroidery frame 53 is farthest to the front in the front-rear direction and farthest to the left in the left-right direction. The distance by which the embroidery frame 53 is moved from the initial position to each of the image capture positions differs according to the type of the embroidery frame 53. Therefore, the coordinates of the image capture positions for each type of the embroidery frame 53 are stored in the image capture position table. The communication interface 65 is an interface for connecting the sewing machine 1 to the network 9.

The operation switches 21, the touch panel 26, a detection portion 27, and drive circuits 70 to 76 are electrically connected to the input/output interface 66. The detection portion 27 is configured to detect whether or not the embroidery frame 53 has been mounted in embroidery device 2, to detect the type of the embroidery frame 53 that has been mounted in the embroidery device 2, and to input the detection results to the CPU 61 through the input/output interface 66. The drive circuits 70 to 76 may respectively drive the presser motor 89, the sewing machine motor 79, the feed motor 80, the swinging motor 81, the X axis motor 82, the Y axis motor 83, and the LCD 15.

An electrical configuration of the portable terminal 3 will be explained with reference to FIG. 4. The portable terminal 3 includes a CPU 121, a ROM 122, a RAM 123, a flash ROM 124, a communication interface 125, and an input/output interface 128. The CPU 121 is configured to control the portable terminal 3. The CPU 121 is electrically connected to the ROM 122, the RAM 123, the flash ROM 124, the communication interface 125, and the input/output interface 128 through a bus 127. A boot program, a BIOS, and the like are stored in the ROM 122. Data are stored temporarily in the RAM 123. A program for causing the CPU 121 to perform first processing that will be described later is stored in the flash ROM 124, along with various types of setting values, including a sewing area table. The sewing area table is a portion of the table that is shown in FIG. 3. The sewing area table shows the correspondence relationships among the sizes of the sewing areas 45, the IDs, and relative positions of characteristic points P1 to P6 that are included in the reference marks 150. In the present embodiment, a characteristic point that is included in a mark (for example, the reference mark 150) is a point that is used in processing that detects the mark and computes the position of the mark, based on image data for a captured image of the mark. In the present embodiment, each of the reference marks 151 to 154 is a single round, black pattern. Each one of the characteristic points P1 to P4 that are included in the reference marks 151 to 154 is a center point of a round, black pattern. In the present embodiment, each of the reference marks 155 and 156 is a circular pattern. Each one of the characteristic points P5 and P6 that are included in the reference marks 155 to 156 is a center point of a circular pattern. In the present embodiment, the sewing area 45 has a rectangular shape whose sides are parallel to the X axis and the Y axis, as shown in FIG. 2. Accordingly, the size of the sewing area 45 is expressed in the embroidery coordinate system in terms of its length along the X axis and its length along the Y axis, as shown in FIG. 3. The communication interface 125 is an interface for connecting the portable terminal 3 to the network 9.

The operation switch 131, the touch panel 132, a microphone 133, a speaker 134, the display portion 135, and the camera 136 are connected to the input/output interface 128. The microphone 133 is configured to convert ambient sounds into audio data and inputs the audio data to the input/output interface 128. The speaker 134 is configured to output sound based on audio data that is output from the input/output interface 128. The display portion 135 is configured to display an image based on image data. The display portion 135 may be a liquid crystal display, for example. The camera 136 is configured to capture an image of a specified image capture range and to create image data. The created image data may be stored in the RAM 123.

Figure 6:
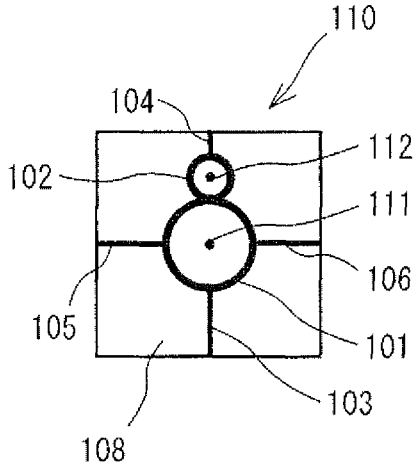
FIG. 6 is an explanatory figure of an indicator mark.

The indicator mark 110 will be explained with reference to FIG. 6. The indicator mark 110 is a mark that the user uses to indicate the positioning of an embroidery pattern 200 on the sewing workpiece 5 that is clamped in the embroidery frame 53. When the user indicates the positioning of the embroidery pattern 200 with the indicator mark 110, the user affixes the indicator mark 110 onto the sewing workpiece 5 that is clamped in the embroidery frame 53, in an area of the sewing workpiece 5 that is inside the embroidery frame 53, specifically inside the sewing area 45. The indicator mark 110 includes a thin, white sheet 108 and a line drawing that is drawn in black on the top face of the sheet 108. The sheet 108 has a square shape that is 2.5 centimeters high and 2.5 centimeters wide, for example. The line drawing that is drawn on the top face of the sheet 108 includes a first circle 101, a first center point 111 at the center of the first circle 101, a second circle 102, a second center point 112 at the center of the second circle 102, and line segments 103, 104, 105, and 106.

The first circle 101 is drawn with the center point of the square sheet 108 serving as the first center point 111. The second circle 102 is drawn in a position where it is tangent to the first circle 101 and where a virtual straight line (not shown in the drawings) that passes through the first center point 111 and the second center point 112 is parallel to one side of the sheet 108. The diameter of the second circle 102 is smaller than the diameter of the first circle 101. The line segment 103 and the line segment 104 are line segments that are superposed on the virtual straight line (not shown in the drawings) that passes through the first center point 111 and the second center point 112, and they respectively extend from the first circle 101 and the second circle 102 to an outer edge of the sheet 108. The line segment 105 and the line segment 106 are line segments that are superposed on a virtual straight line (not shown in the drawings) that passes through the first center point 111 of the first circle 101 and is orthogonal to the line segment 103, and each of them extends from an outer edge of the first circle 101 to an outer edge of the sheet 108. In the present embodiment, the first center point 111 and the second center point 112 are characteristic points of the indicator mark 110.

Figure 7:
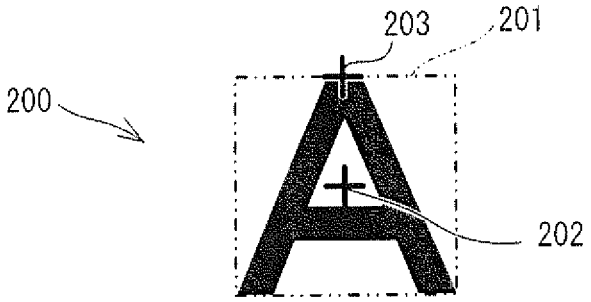
FIG. 7 is an explanatory figure of an embroidery pattern.

An embroidery pattern, the pattern data, and embroidery data will be explained using the embroidery pattern 200 that is shown in FIG. 7 as an example. Note that the left-right direction and the up-down direction in FIG. 7 respectively correspond to the X axis direction and the Y axis direction in the embroidery coordinate system.

The embroidery pattern 200 that is shown in FIG. 7 is a pattern that represents an uppercase letter A. The pattern data are data for forming the stitches that will make up the embroidery pattern 200 when the embroidery pattern 200 is in its initial position. In the present embodiment, the initial position of the embroidery pattern 200 is set at the center of the sewing area 45. The pattern data include coordinate data. The coordinate data indicate the positions of needle drop points and a sewing order of the needle drop points. In the present embodiment, the positions of the needle drop points are indicated in terms of the coordinates of the previously described embroidery coordinate system. All of the coordinate data in the pattern data are specified such that a center point 202 of the embroidery pattern 200 (more specifically, the center point of a rectangle 201 that is the smallest rectangle within which the embroidery pattern 200 can be contained) is congruent with the origin point of the embroidery coordinate system. The origin point of the embroidery coordinate system is the position at which a center point 46 of the sewing area 45 (refer to FIG. 3) becomes the needle drop point.

The embroidery data are data for forming the stitches that make up the embroidery pattern 200 at at least one of the position and the angle that the user has indicated by using the indicator mark 110. In the present embodiment, the embroidery data are data for forming the stitches that make up the embroidery pattern 200 at the position and the angle that the user has indicated by using the indicator mark 110. The embroidery data include coordinate data. In the present embodiment, all of the coordinate data in the embroidery data are specified such that the center point 202 of the embroidery pattern 200 (more specifically, the center point of the rectangle 201 that is the smallest rectangle within which the embroidery pattern 200 can be contained) is congruent with the first center point 111 of the indicator mark 110 in the embroidery coordinate system. Furthermore, in the present embodiment, the coordinate data in the embroidery data are specified such that the slope of a line segment that links the center point 202 of the embroidery pattern 200 to a point 203 matches the slope of a line segment that links the first center point 111 and the second center point 112 of the indicator mark 110 in the embroidery coordinate system.

Processing that is performed in the sewing machine system 100 of the present embodiment will be explained with reference to FIGS. 8 to 12. In the explanation that follows, a case in which the embroidery pattern 200 that is shown in FIG. 7 is sewn on the sewing workpiece 5 at the position and the angle that are indicated by the indicator mark 110 will be used as a specific example. The first processing that is performed by the portable terminal 3 will be explained first, with reference to FIGS. 8 to 11. In the first processing, the portable terminal 3 performs processing that creates the image data, then computes the positioning data based on the image data that have been created. The positioning data are data that indicate at least one of the position and the angle of the indicator mark 110 in relation to the reference marks 150. In the present embodiment, the positioning data are data that indicate both the position and the angle of the indicator mark 110 in relation to the reference marks 150. After receiving a pattern size and an image capture permission from the sewing machine 1, the portable terminal 3, by controlling the camera 136, creates image data for an image that is captured of the specified image capture range, based on a user command. The pattern size defines the X axis length and the Y axis length of the smallest rectangle within which the embroidery pattern to be sewn can be contained. The specified image capture range includes at least one of the reference marks 150 of the embroidery frame 53 and the indicator mark 110, which is placed on the sewing workpiece 5 that is clamped in the embroidery frame 53 in an area that is inside the embroidery frame 53. In the present embodiment, the user sets the image capture range such that at least four of the six reference marks 150 are included in the captured image. In the present embodiment, one indicator mark 110 is affixed in the area inside the embroidery frame 53. The portable terminal 3 computes the positioning data based on the image data that have been created. The portable terminal 3 confirms that the embroidery pattern will fit within the sewing area 45 in a case where the embroidery pattern has been positioned as has been determined based on the positioning data. After confirming the positioning of the embroidery pattern, the portable terminal 3 outputs the positioning data to the sewing machine 1 through the communication interface 125. The embroidery frame 53 for which the ID is 2 will be used in the following explanation.

The CPU 121 of the portable terminal 3 starts the first processing when the user inputs a command to start the first processing. Specifically, when the CPU 121 detects the input of the command to start the first processing, the CPU 121 reads into the RAM 123 a program for performing the first processing, which is stored in the flash ROM 124 (refer to FIG. 4). In accordance with the instructions that are contained in the program, the CPU 121 performs the processing at the individual steps that will hereinafter be explained. Note that in the present embodiment, the user, prior to inputting the command to start the first processing, clamps the sewing workpiece 5 in the embroidery frame 53 and affixes the indicator mark 110 to the top face of the sewing workpiece 5. In other words, the user completes the preparation for capturing the image before inputting the command to start the first processing.

Figure 8:
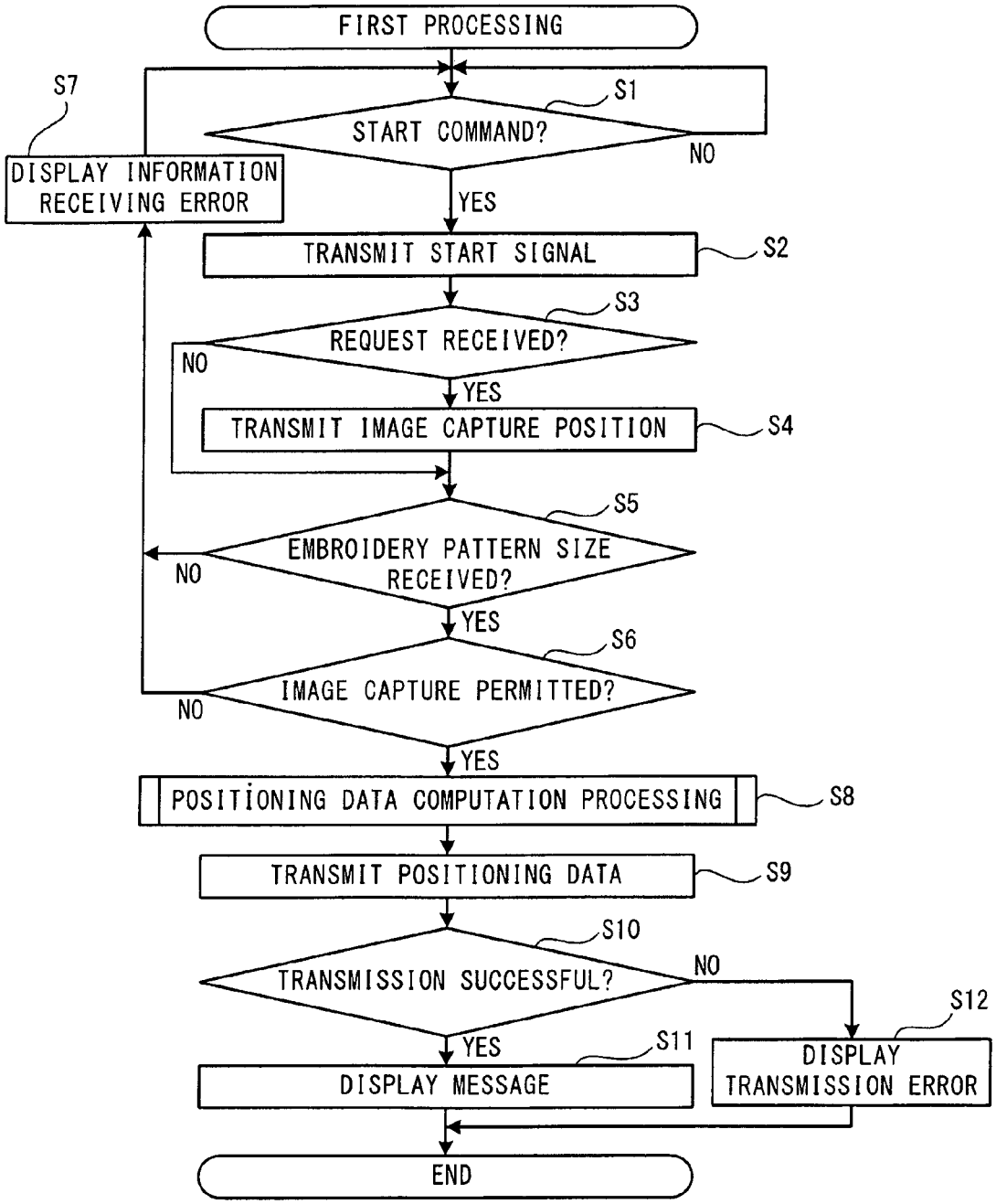
FIG. 8 is a flowchart of first processing that is performed by the portable terminal.

As shown in FIG. 8, in the first processing, the CPU 121 first determines whether or not a command has been input to start processing for outputting the positioning data to the sewing machine 1 using the portable terminal 3 (Step S1). The user may input the command at Step S1 by operating the operation switch 131, for example. In a case where the start command has not been input (NO at Step S1), the CPU 121 waits until the start command is input. In a case where the start command has been input (YES at Step S1), the CPU 121 transmits a start signal to the sewing machine 1 through the communication interface 125 (Step S2). The start signal includes address information for the portable terminal 3. The address of the sewing machine 1 may be input by the user when the first processing is performed, and may also be stored in advance in a storage device such as the flash ROM 124 or the like. In a case where the user inputs the address of the sewing machine 1 when the first processing is performed, the CPU 121 stores the address that has been input in the RAM 123 and refers to the address when transmitting data to the sewing machine 1 during the first processing.

The CPU 121 determines whether or not data that include an image capture position transmission request have been received from the sewing machine 1 (Step S3). In the sewing machine system 100, in a case where the embroidery frame 53 is mounted on the embroidery device 2 when the first processing is performed, a determination is made that an image of the embroidery frame 53 will be captured in the state in which the embroidery frame 53 is mounted on the embroidery device 2. The sewing machine 1 moves the embroidery frame 53 to an image capture position that is suitable for capturing an image of the embroidery frame 53. In the present embodiment, the three types of the image capture positions are set as described previously. As will be described below, in a case where the embroidery frame 53 is mounted on the embroidery device 2 when the first processing is performed, the sewing machine 1 transmits the image capture position transmission request to the portable terminal 3. The image capture position transmission request is a request that asks the portable terminal 3 to transmit to the sewing machine 1 a command that specifies one of the three types of the image capture positions. In the present embodiment, the user operates the portable terminal 3 to designate one of the three types of the image capture positions.

In the sewing machine system 100, in a case where the embroidery frame 53 is mounted on the embroidery device 2, the sewing machine 1, having received the start signal that was transmitted at Step S2, transmits the image capture position transmission request to the portable terminal 3 within a specified time period (for example, three minutes). In a case where the image capture position transmission request is not received within the specified time period, the CPU 121 determines that the image capture position transmission request has not been received (NO at Step S3). In a case where the data that include the image capture position transmission request have been received (YES at Step S3), the CPU 121 stores the received data in the RAM 123. In some cases, frame data that will be described later may be included in the image capture position transmission request that was received at Step S3, along with the address of the sewing machine 1. The CPU 121 accepts the designation of the image capture position that has been input by the user and transmits information on the designated image capture position to the sewing machine 1 through the communication interface 125 (Step S4). In a case where the image capture position transmission request has not been received (NO at Step S3), as well as after the processing at Step S4, the CPU 121 determines whether or not data that were transmitted from the sewing machine 1 and include the pattern size have been received (Step S5). In a case where the data that were transmitted from the sewing machine 1 and include the pattern size have been received (YES at Step S5), the CPU 121 stores the received data in the RAM 123. In some cases, the frame data that will be described later may be included in the pattern size that was received at Step S5, along with the address of the sewing machine 1. In the present embodiment, in a case where the image capture position transmission request has been received (YES at Step S3), if the data that include the pattern size have not been received within a specified time period (for example, three minutes) after the image capture position was transmitted at Step S4, the CPU 121 determines that the pattern size has not been received (NO at Step S5). In a case where the image capture position transmission request has not been received (NO at Step S3), if the pattern size has not been received within a specified time period (for example, five minutes) after the start signal was transmitted, the CPU 121 determines that the pattern size has not been received (NO at Step S5). In a case where the data that were transmitted from the sewing machine 1 and include the pattern size have not been received within the specified time period (NO at Step S5), the CPU 121 displays an information receiving error message on the display portion 135 (Step S7), then returns the processing to Step S1. The information receiving error message at Step S7 notifies the user that information that is necessary for the processing that outputs the positioning data to the sewing machine 1 using the portable terminal 3 was not received from the sewing machine 1. Next, the CPU 121 determines whether or not the image capture permission has been acquired from the sewing machine 1 (Step S6). In the sewing machine system 100, the portable terminal 3 performs the processing that creates the image data after the portable terminal 3 has received the image capture permission from the sewing machine 1. This is because, in a case where the embroidery frame 53 is mounted on the embroidery device 2, the sewing machine system 100 causes the portable terminal 3 to perform the image capture after the embroidery frame 53 has been moved to the image capture position that the user has designated. In the present embodiment, in a case where the pattern size has been received (YES at Step S5), if the image capture permission is not received within a specified time period (for example, three minutes) after the pattern size was received, the CPU 121 determines that the image capture permission has not been received (NO at Step S6).

In a case where the image capture permission has not been received (NO at Step S6), the CPU 121 displays the information receiving error message on the display portion 135 (Step S7), then returns the processing to Step S1. In a case where the image capture permission has been received (YES at Step S6), the CPU 121 performs positioning data computation processing (Step S8). The positioning data computation processing will be explained with reference to FIG. 9. In the positioning data computation processing, first, the CPU 121 determines whether or not an image capture command has been input (Step S31). The user may input the image capture command by operating the operation switch 131, for example. The CPU 121 causes the display portion 135 to display an image that is represented by the most recent image data that the camera 136 has created. The image that is displayed by the display portion 135 corresponds to the image capture range of the camera 136. The center of the image is the center of the image capture range. In a case where an image is captured in a state in which the embroidery frame 53 has been mounted on the embroidery device 2, the user includes at least the reference marks 153 to 156 and the indicator mark 110 in the image capture range. In a case where an image is captured in a state in which the embroidery frame 53 has been removed from the embroidery device 2, it is preferable for the six reference marks 150 and the indicator mark 110 to be included in the image capture range, as shown in FIG. 10, for example. In order to simplify the image processing, it is preferable for the image to be captured in a state in which the embroidery frame 53 has been removed from the embroidery device 2. In a case where the image capture range is set in this manner, the image processing becomes simpler, because members such as the needle bar 29, the sewing needle 28, the presser bar 31, the presser foot 30, and the like of the sewing machine 1 are not included in the captured image. Regardless of whether or not the embroidery frame 53 is mounted on the embroidery device 2, in the interests of simplifying the processing and improving the precision of the detection of the reference marks 150, the portable terminal 3 may also display a recommended range in which the reference marks 150 should be positioned, the recommended range being superimposed on the image that shows the image capture range. In that case, the user may adjust the image capture range by shifting the position of the portable terminal 3 such that the reference marks 150 are positioned within the recommended range, or by altering the focus of the camera 136.

In a case where the image capture command has not been input (NO at Step S31), the CPU 121 waits until the image capture command is input. In a case where the image capture command has been input (YES at Step S31), the CPU 121 controls the camera 136 to create the image data for the image that has been captured of the image capture range, then stores the image data in the RAM 123 (Step S32). In the explanation that follows, a case in which the image in FIG. 10 is represented based on the image data that were created by the processing at Step S32 will be used as a specific example. Based on the image data, the CPU 121 detects the reference marks 150 in the captured image (Step S33). The captured image is an image that is based on the image data that were created by the processing at Step S32. The captured image may be an image that is represented by the image data that were created by the processing at Step S32, and the captured image may also be an image that results from some sort of processing, such as correction processing or the like, that is performed on the image data that were created by the processing at Step S32. Any known image detection method may be used for detecting the reference marks 150. For example, the CPU 121 may detect the reference marks 150 by using edge detection to identify the characteristic points. In the present embodiment, one characteristic point is detected in each one of the reference marks 150. In the specific example, based on the image data, the characteristic points P1 to P6 are respectively detected in the reference marks 151 to 156 in the captured image in FIG. 10. In the present embodiment, the round, black patterns in the reference marks 151 to 154 are the same as the round, black patterns in the type mark 160. The CPU 121 may distinguish between the reference marks 150 and the type mark 160 based on the positioning of the characteristic points, for example. Within the captured image, in the processing at Step S33, the CPU 121 detects the positions of the characteristic points P1 to P6 that are respectively included in the reference marks 150 as reference positions.

The CPU 121 determines whether or not at least the reference marks 153 to 156, from among the reference marks 150, have been successfully detected (Step S34). As explained previously, in the present embodiment, the reference marks 151 to 154 are provided on the top face of the first frame 55, close to the four corners of the sewing area 45, respectively. That means that if all four of the reference marks 151 to 154 are included in the captured image, the area on the inside of the embroidery frame 53 and the indicator mark 110 are also included in the captured image. Therefore, in a case where the area in which the indicator mark 110 is possibly disposed is the entire sewing area 45, it is preferable for the reference marks 151 to 156 to be detected. A case in which the reference marks 151 to 156 are detected in the captured image based on the image data will be called a case in which the image is captured under a first image capture condition. In a case where the area in which the indicator mark 110 is possibly disposed is the front half of the sewing area 45, it is possible for the processing to be performed as long as the reference marks 153 to 156 are detected, even if the reference marks 151 and 152 are not detected. A case in which the reference marks 153 to 156 are detected in the captured image based on the image data, and at least one of the reference marks 151 and 152 is not detected, will be called a case in which the image is captured under a second image capture condition. Therefore, in the processing at Step S34, the portable terminal 3 checks whether or not at least the reference marks 153 to 156 are included in the captured image.

In a case where at least one of the reference marks 153 to 156 has not been detected (NO at Step S34), the CPU 121 displays an error message on the display portion 135 (Step S35) and returns the processing to Step S31. The error message in the processing at Step S35 notifies the user that at least one of the reference marks 153 to 156 was not detected in the captured image and prompts the user to perform the image capture again. The user may check the error message and, after adjusting the image capture range, may input a command to perform the image capture again.

In a case where at least the reference marks 153 to 156 have been successfully detected (YES at Step S34), the CPU 121 determines whether or not the frame data are included in the data that were received at one of Step S3 and Step S5 in FIG. 8 (Step S36). The frame data are data that indicate the type of the embroidery frame 53. In a case where the frame data are not included in the data that were received at one of Step S3 and Step S5 (NO at Step S36), the CPU 121 detects the type mark 160 in the captured image (Step S37). For example, based on the image data, the CPU 121 may detect the type mark 160 by distinguishing between the reference marks 150 and the type mark 160 based on the positioning of the characteristic points in the captured image. The CPU 121 determines whether or not the type mark 160 has been successfully detected (Step S38). In a case where the type mark 160 has not been detected (NO at Step S38), the CPU 121 displays an error message on the display portion 135 (Step S39) and returns the processing to Step S31. The error message in the processing at Step S39 notifies the user that the type mark 160 was not detected based on the captured image and prompts the user to perform the image capture again. The user may check the error message and may input a command to perform the image capture again. In a case where the type mark 160 has been successfully detected (YES at Step S38), the CPU 121 specifies the type of the embroidery frame 53, based on the number of the round, black patterns that are included in the type mark 160 and on the sewing area table that is stored in the flash ROM 124 (Step S40). In the specific example that is shown in FIG. 10, the number of the round, black patterns that are included in the type mark 160 is two. Therefore, the CPU 121 specifies the embroidery frame 53 for which the ID is 2 as the type of the embroidery frame 53.

In a case where the frame data are included in the data that were received at one of Step S3 and Step S5 (YES at Step S36), as well as after the processing at Step S40, the CPU 121 acquires the actual relative position, in relation to a standard position, for each one of the characteristic points that are included in the reference marks 150, in accordance with the type of the embroidery frame 53 and the image capture condition (Step S41). The type of the embroidery frame 53 is indicated by the frame data or was specified at Step S40. The image capture condition is a condition that is classified according to the reference marks 150 that were detected by the processing at Step S33. In the present embodiment, there are two types of the image capture condition, that is, the first image capture condition and the second image capture condition that were described above. In the present embodiment, the standard position is the origin point of the embroidery coordinate system, and the relative positions are expressed in terms of the coordinates of the embroidery coordinate system. In a case where the image has been captured under the first image capture condition, the CPU 121 refers to the sewing area table and acquires the relative positions of the characteristic points P1 to P4 that correspond to the type of the embroidery frame 53. In a case where the image has been captured under the second image capture condition, the CPU 121 refers to the sewing area table and acquires the relative positions of the characteristic points P3 to P6 that correspond to the type of the embroidery frame 53. In the specific example that is shown in FIG. 10, the image is captured under the first image capture condition (Step S33), and based on one of the frame data and the type mark 162, the embroidery frame 53 for which the ID is 2 is specified as the type of the embroidery frame 53 (YES at Step S36, or Step S40). Therefore, in the processing at Step S41, the CPU 121 acquires the coordinates (X21, Y21), (X22, Y22), (X23, Y23), and (X24, Y24) as the relative positions for the characteristic points P1 to P4, respectively.

Based on the image data, the CPU 121 detects the orientation of the embroidery frame 53 within the captured image. In the present embodiment, the CPU 121 determines that, of the four sides of the substantially rectangular first frame 55, the side where the type mark 160 is located is the front side. Therefore, in the specific example that is shown in FIG. 10, the CPU 121 determines that the bottom side of the image is the front side of the embroidery frame 53, and that the center points of the round, black patterns in the upper left, the upper right, the lower right, and the lower left of the image in FIG. 10 respectively correspond to the characteristic points P1 to P4 of the reference marks 151 to 154. Based on the orientation of the embroidery frame 53, the CPU 121 assigns the coordinates (X21, Y21), (X22, Y22), (X23, Y23), and (X24, Y24) to the corresponding characteristic points P1 to P4 that are included in the captured image (Step S42). For each one of the characteristic points that are included in the reference marks 150, in the processing at Step S42, the CPU 121 sets the relative position that corresponds to the reference position. The reference position is the position of the characteristic point in the captured image. In a case where the image is captured under the second image capture condition, the relative positions are assigned for the individual characteristic points P3 to P6 at Step S42.

Figure 10:
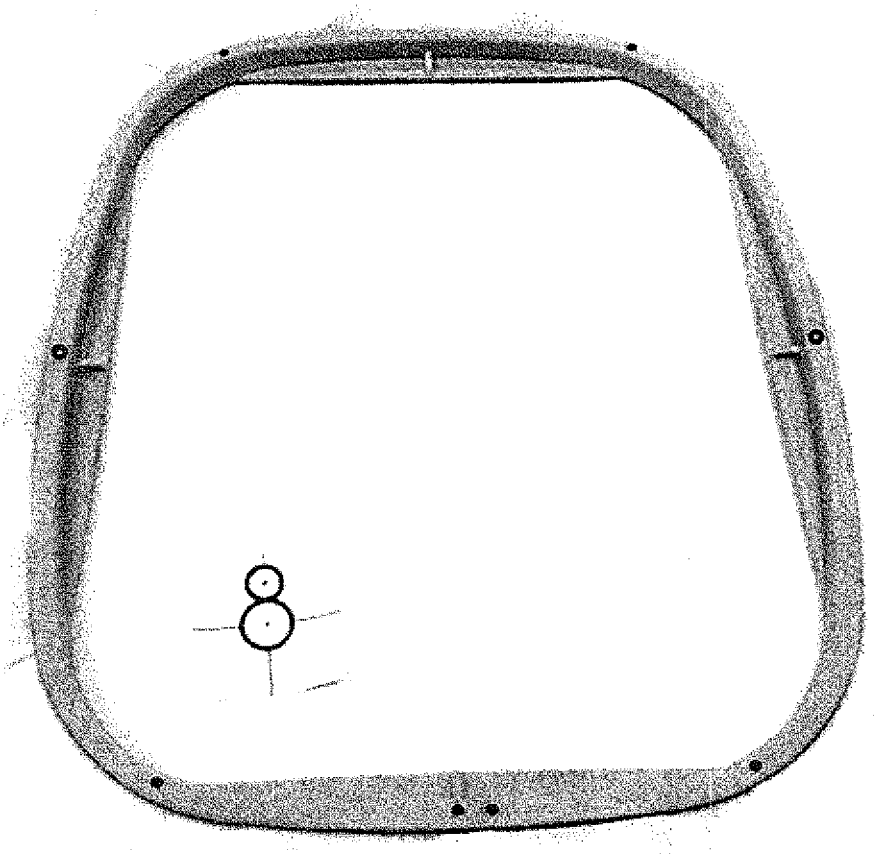
FIG. 10 is a captured image that is represented by image data that are created by the first processing.
Figure 11:
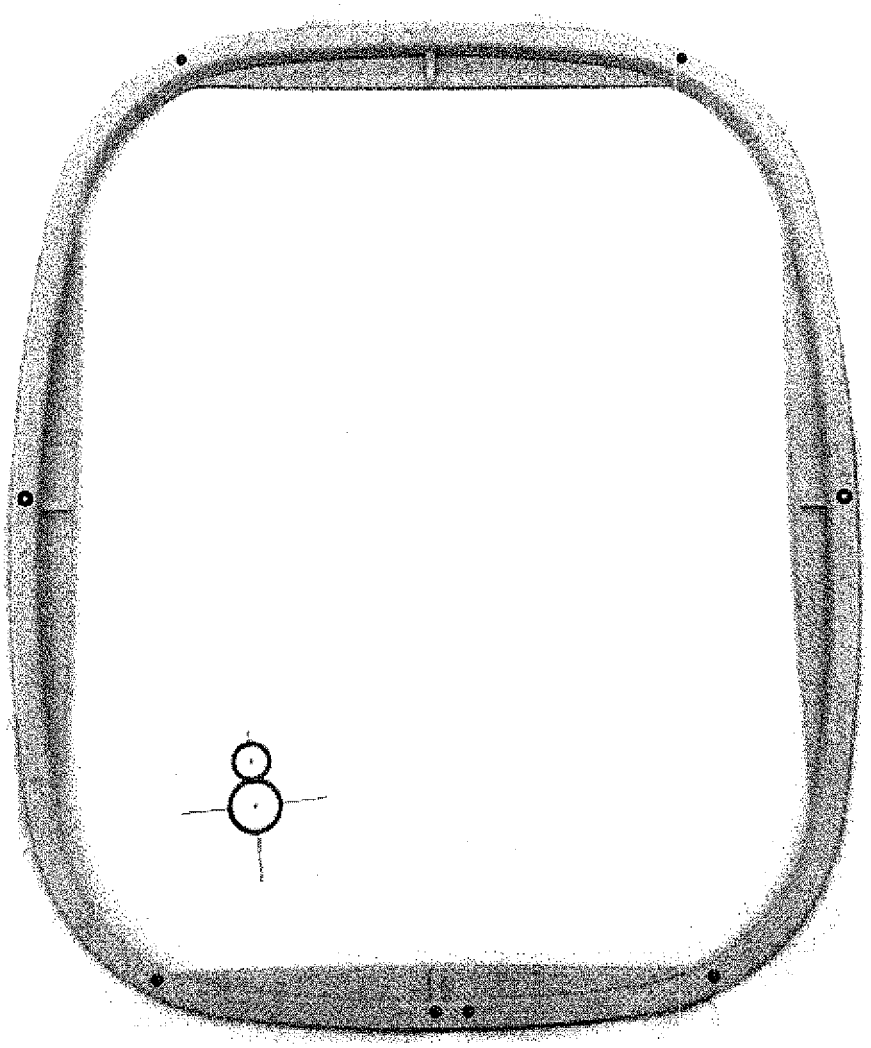
FIG. 11 is the captured image that is represented by the image data after the image data are corrected.

Based on the correspondence relationships between the reference positions and the relative positions for the characteristic points of the reference marks 150, the CPU 121 corrects the image that is described by the image data that were created at Step S32 (Step S43). In the processing at Step S43 in the present embodiment, the CPU 121 corrects distortion in the captured image by using a known keystone correction method. In the processing at Step S43, the CPU 121 converts the captured image that is shown in FIG. 10 into the captured image that is shown in FIG. 11. The captured image that is shown in FIG. 11 is equivalent to an image that would be obtained when the embroidery frame 53 that holds the sewing workpiece 5 is placed in a horizontal state and the image is captured from directly above the embroidery frame 53. The up-down direction and the left-right direction in FIG. 11 respectively correspond to the Y axis direction and the X axis direction in the embroidery coordinate system.

Based on the image data, the CPU 121 detects the indicator mark 110 in the captured image (Step S44). Any known image recognition method may be used for detecting the indicator mark 110. For example, the CPU 121 may perform edge detection and perform pattern matching using a template that shows the outlines of the first circle 101 and the second circle 102, as well as the line segments 103 to 106. For example, within the captured image, in the processing at Step S44, the CPU 121 may detect the positions of the two characteristic points in the indicator mark 110 as indicator positions. In a case where the indicator mark 110 is not detected (NO at Step S45), there is a strong possibility that the indicator mark 110 has not been affixed in an appropriate position or that the indicator mark 110 is not located within the image capture range. Accordingly, the CPU 121 displays an error message on the display portion 135 (Step S46) and returns the processing to Step S31. The error message in the processing at Step S46 prompts the user to affix the indicator mark 110 again in an area inside the sewing area 45 of the embroidery frame 53.

In a case where the indicator mark 110 is detected (YES at Step S45), the CPU 121 computes, as the positioning data, data that indicate the position and the angle of the indicator mark 110 in relation to the reference marks 150 (Step S47). Hereinafter, the position and the angle will simply be called the positioning. The plurality (specifically, six in the present embodiment) of the reference marks 150 are positioned on the embroidery frame 53, and their relative positions are known. Therefore, the CPU 121 is able to acquire the coordinates in the embroidery coordinate system that correspond to the indicator positions by computing the coordinates based on the reference positions of the characteristic points that are included in the reference marks 150, on the known relative positions that correspond to the reference positions, and on the indicator positions. Each of the indicator positions is a position, in the captured image, of each of the at least one characteristic point that is included in the indicator mark 110. In the present embodiment, the indicator mark 110 has the two characteristic points of the first center point 111 and the second center point 112. Accordingly, the CPU 121 may compute, as the positioning data, data that indicate the coordinates in the embroidery coordinate system of the first center point 111 and the second center point 112 of the indicator mark 110 that was detected at Step S44, for example. The coordinates of the first center point 111 in the embroidery coordinate system represent the position of the indicator mark 110 on the sewing workpiece 5 and are used to indicate the position of the embroidery pattern 200. The coordinates of the first center point 111 and the second center point 112 in the embroidery coordinate system represent the angle of the indicator mark 110 and are used to indicate the angle of the embroidery pattern 200. In addition to being represented by the coordinates of the first center point 111 and the second center point 112 in the embroidery coordinate system, the angle of the indicator mark 110 may be represented by the angle in relation to a reference (for example, the X axis or the Y axis of the embroidery coordinate system).

The CPU 121 sets the positioning of the embroidery pattern 200 based on the pattern size that was received by the processing at Step S5 in FIG. 8 and on the positioning data that were computed at Step S47 (Step S48). At Step S48, based on the pattern size that was transmitted from the sewing machine 1, the CPU 121 sets the smallest rectangle 201 within which the embroidery pattern 200 can be contained. The CPU 121 sets the positioning of the smallest rectangle 201 as the positioning of the embroidery pattern 200. In the specific example, the CPU 121 sets the position of the smallest rectangle 201 in relation to the embroidery frame 53 such that the center point 202 of the smallest rectangle 201 within which the embroidery pattern 200 can be contained is congruent with the first center point 111 of the indicator mark 110 in the embroidery coordinate system, as shown in FIG. 2. The CPU 121 sets the angle of the smallest rectangle 201 in relation to the embroidery frame 53 such that the slope of a line segment that links the center point 202 to the point 203 matches the slope of a line segment that links the first center point 111 and the second center point 112 of the indicator mark 110 in the embroidery coordinate system.

The CPU 121 acquires information that indicates the range of the sewing area 45 that corresponds to the type of the embroidery frame 53 (Step S49). In the specific example, the CPU 121 refers to the sewing area table that is stored in the flash ROM 124 and acquires the X axis length X27 and the Y axis length Y27 that indicate, in terms of the embroidery coordinate system, the size of the sewing area 45 for the embroidery frame 53 for which the ID is 2. In the processing at Step S49, the CPU 121 sets the sewing area 45 that is shown inside the first frame 55 of the embroidery frame 53 in FIG. 2. Based on the positioning of the embroidery pattern 200 that was set at Step S48 and on the information that indicates the range of the sewing area 45 that was acquired at Step S49, the CPU 121 determines whether or not the embroidery pattern 200 can fit within the sewing area 45 when the embroidery pattern 200 is positioned as set by the processing at Step S48 (Step S50). In a case where the smallest rectangle 201 fits entirely within the sewing area 45, the CPU 121 determines that the embroidery pattern 200 can fit within the sewing area 45. In a case where the embroidery pattern 200 cannot fit within the sewing area 45 (NO at Step S50), the CPU 121 displays an error message on the display portion 135 (Step S51). The error message in the processing at Step S51 is a message that notifies the user that the embroidery pattern 200 will not fit within the sewing area 45 and prompts the user to perform again the operations that set the positioning of the embroidery pattern 200. The CPU 121 returns the processing to Step S31. In a case where the embroidery pattern 200 can fit within the sewing area 45 (YES at Step S50), the CPU 121 displays the positioning data on the display portion 135 (Step S52). The CPU 121 terminates the positioning data computation processing and returns the processing to the first processing in FIG. 8.

Figure 9:
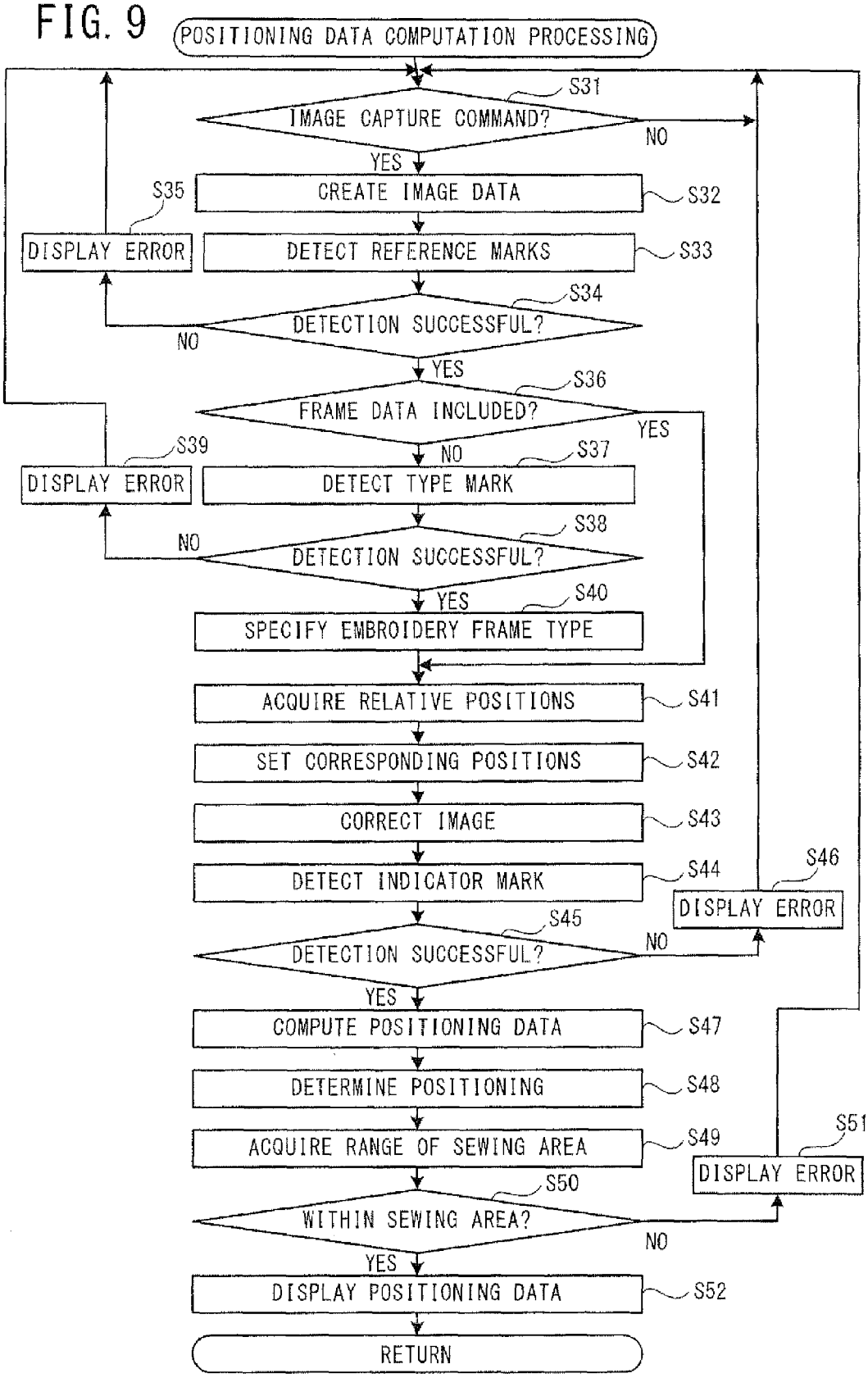
FIG. 9 is a flowchart of positioning data computation processing that is performed in the first processing in FIG. 8.

As shown in FIG. 8, after the positioning data computation processing (Step S8), the CPU 121 outputs the positioning data that were computed by the processing at Step S47 in FIG. 9 to the sewing machine 1 through the communication interface 125 (Step S9). In the present embodiment, the portable terminal 3 includes the address of the portable terminal 3 and the positioning data in the data that is transmitted to the sewing machine 1 at Step S9. The CPU 121 determines whether or not the positioning data have been successfully transmitted (Step S10). In a case where a successful receiving message is received from the sewing machine 1 within a specified time period (for example, three minutes) after the positioning data were transmitted to the sewing machine 1, the CPU 121 determines that the positioning data have been successfully transmitted (YES at Step S10). In that case, the CPU 121 displays on the display portion 135 a message that notifies the user that the transmission of the positioning data was carried out normally (Step S11), then terminates the first processing. In a case where the successful receiving message has not been received within the specified time period after the positioning data were transmitted to the sewing machine 1 (NO at Step S10), the CPU 121 displays a transmission error message on the display portion 135 (Step S12), then terminates the first processing. The transmission error message is a message that notifies the user that the transmission of the positioning data was not carried out normally.

The second processing that is performed by the sewing machine 1 will be explained with reference to FIG. 12. The second processing is processing that sets the positioning of the embroidery pattern 200 that has been selected by the user, based on the positioning data that have been transmitted from the portable terminal 3, then forms the stitches that make up the embroidery pattern 200 for which the positioning has been set. Specifically, the sewing machine 1 transmits to the portable terminal 3 the pattern size for the embroidery pattern 200 to be sewn, then receives the positioning data that are transmitted from the portable terminal 3. The positioning data that the sewing machine 1 receives are the data that were computed by the previously described first processing. In other words, the positioning data are the data for which the CPU 121 determined that the embroidery pattern 200 would fit within the sewing area 45 in a case where the embroidery pattern 200 is positioned according to the positioning that is set based on the positioning data. Based on the positioning data, the sewing machine 1 sets at least one of the position and the angle of the embroidery pattern 200 on the sewing workpiece 5 that is clamped in the embroidery frame 53. In the present embodiment, based on the positioning data, the sewing machine 1 sets both the position and the angle of the embroidery pattern 200 on the sewing workpiece 5 that is clamped in the embroidery frame 53. Based on the position and the angle that have been set, and on the pattern data, the sewing machine 1 creates the embroidery data, which are the data for forming the stitches that make up the embroidery pattern 200. Based on the embroidery data, the sewing machine 1 controls the embroidery device 2 and the needle bar up-and-down moving mechanism 84 to sew the embroidery pattern 200 on the sewing workpiece 5 that is clamped in the embroidery frame 53.

The CPU 61 of the sewing machine 1 starts the second processing when the user inputs a command to start the second processing by a panel operation. When the CPU 61 detects the input of command to start the second processing, the CPU 61 reads into the RAM 63 the program for performing the second processing, which is stored in the ROM 62 (refer to FIG. 4). In accordance with the instructions that are contained in the program, the CPU 61 performs the processing at the individual steps that will hereinafter be explained. In the present embodiment, the previously described first processing is performed at least between the processing at Step S63 and the processing at Step S73, which will be described later.

Figure 12:
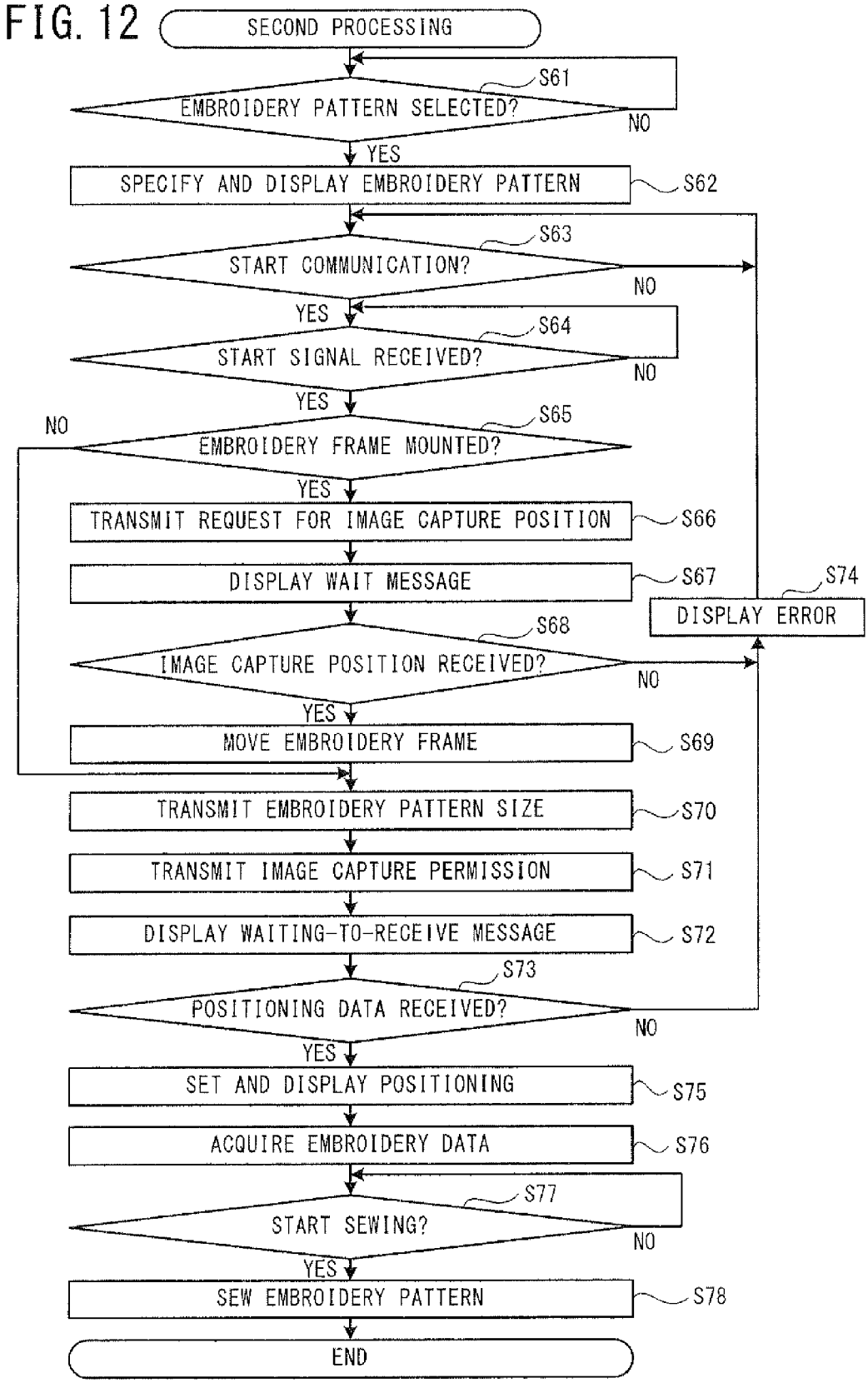
FIG. 12 is a flowchart of second processing that is performed by the sewing machine.

As shown in FIG. 12, in the second processing, first, the CPU 61 accepts the selecting of an embroidery pattern that will be sewn (Step S61). Specifically, the CPU 61 causes a screen to be displayed on the LCD 15 (refer to FIG. 1) that shows a plurality of embroidery patterns for which the pattern data are stored in the flash ROM 64, for example. The CPU 61 waits until the user selects one of the displayed embroidery patterns by a panel operation (NO at Step S61). When the user selects one of the displayed embroidery patterns by a panel operation (YES at Step S61), the CPU 61 specifies the embroidery pattern that has been selected (hereinafter called the selected pattern) as an object to be sewn, then displays the selected pattern on the LCD 15 (Step S62). The CPU 61 acquires the pattern data for the selected pattern from the ROM 62 and stores the pattern data in the RAM 63. In the explanation that follows, a case in which the embroidery pattern 200 in FIG. 7 has been specified as the selected pattern will be used as a specific example.

The CPU 61 waits until a command is input to start communication with the portable terminal 3 (NO at Step S63). The command may be input by a panel operation by the user, for example. In a case where the command has been input (YES at Step S63), the CPU 61 waits until the CPU 61 receives the start signal that is transmitted from the portable terminal 3 (NO at Step S64). The start signal is transmitted from the portable terminal 3 by the processing at Step S2 in FIG. 8. In a case where the start signal has been received (YES at Step S64), the CPU 61 stores the received start signal in the RAM 63.

The CPU 61 determines whether or not the embroidery frame 53 has been mounted, based on the result that has been output from the detection portion 27 (Step S65). In a case where the embroidery frame 53 has been mounted (YES at Step S65), the CPU 61 transmits the image capture position transmission request to the portable terminal 3 through the communication interface 65 (Step S66). The address of the portable terminal 3 is specified based on the start signal that was received at Step S64 and stored in the RAM 63. The CPU 61 may also include in the image capture position transmission request the frame data that are specified based on the result that has been output from the detection portion 27. The CPU 61 displays a waiting-to-receive message on the LCD 15 (Step S67). The waiting-to-receive message in the processing at Step S67 notifies the user that the sewing machine 1 is in a state of waiting for the image capture position to be transmitted from the portable terminal 3. The user may check the waiting-to-receive message and may perform an operation that uses the portable terminal 3.

The CPU 61 determines whether or not the image capture position that was transmitted from the portable terminal 3 has been received (Step S68). In a case where the image capture position has not been received within a specified time period (for example, three minutes) after the image capture position transmission request was transmitted to the portable terminal 3 by the processing at Step S66 (NO at Step S68), the CPU 61 displays a receiving error message on the LCD 15 (Step S74), then returns the processing to Step S63. The receiving error message notifies the user that the data that were to be transmitted from the portable terminal 3 have not been received. The receiving error message may also be transmitted to the portable terminal 3 and displayed on the portable terminal 3.

In a case where the image capture position has been received (YES at Step S68), the CPU 61 controls the drive circuits 74 and 75 to move the embroidery frame 53 to the received image capture position (Step S69). The image capture position that the user designates differs according to the type of the embroidery frame 53. The CPU 61, referring to the image capture position table that is stored in the flash ROM 64, acquires the position of the embroidery frame 53 that corresponds to the image capture position that the user designated and the type of the embroidery frame 53, then moves the embroidery frame 53 to the acquired position. For example, in a case where the ID of the embroidery frame 53 is 2 and the image capture position is the left front, the embroidery frame 53 is moved to the position that is indicated by (X20, Y20). In a case where the embroidery frame 53 has not been mounted on the embroidery device 2 (NO at Step S65), as well as after the processing at Step S69, the CPU 61 transmits to the portable terminal 3, through the communication interface 65, the pattern size of the embroidery pattern 200 that was specified at Step S62 (Step S70). The address of the portable terminal 3 is specified based on the start signal that was received at Step S64 and stored in the RAM 63. The CPU 61 may also include in the pattern size the frame data that are specified based on the result that has been output from the detection portion 27. The CPU 61 specifies the pattern size based on the pattern data for the embroidery pattern 200 that were acquired at Step S62. After the processing at Step S70, the CPU 61 transmits the image capture permission to the portable terminal 3 through the communication interface 65 (Step S71). As described previously, when the portable terminal 3 receives the image capture permission, the portable terminal 3 accepts the command to perform image capture.

The CPU 61 displays a waiting-to-receive message on the LCD 15 (Step S72). The waiting-to-receive message in the processing at Step S72 notifies the user that the portable terminal 3 is in a state of being able to perform image capture and that the sewing machine 1 is in a state of waiting for the positioning data to be transmitted from the portable terminal 3. The user may check the waiting-to-receive message and may perform an operation that uses the portable terminal 3. The CPU 61 determines whether or not the positioning data have been received (Step S73). In a case where the positioning data have not been received from the portable terminal 3 within a specified time period (for example, five minutes) after the image capture permission was transmitted at Step S71, the CPU 61 determines that the positioning data have not been received (NO at Step S73). In that case, the CPU 61 displays the receiving error message on the LCD 15 (Step S74), then returns the processing to Step S63. The receiving error message may also be transmitted to the portable terminal 3.

In a case where the positioning data have been received (YES at Step S73), the CPU 61 transmits the successful receiving message to the portable terminal 3. As described previously, the successful receiving message is used in the portable terminal 3 for confirming that the positioning data have been received normally in the sewing machine 1. The CPU 61 sets the positioning of the embroidery pattern 200 based on the pattern data for the embroidery pattern 200 that was specified at Step S62 and on the positioning data that were received at Step S73, then displays the set positioning on the LCD 15 (Step S75). The method for setting the positioning of the embroidery pattern 200 is the same method that was used in the processing at Step S48 in FIG. 9. In the specific example, the CPU 61 sets the position and the angle of the embroidery pattern 200 in relation to the embroidery frame 53, as shown in FIG. 2.

The CPU 61 corrects the pattern data such that the center point 202 of the embroidery pattern 200 is congruent with the first center point 111 of the indicator mark 110 in the embroidery coordinate system. The CPU 61 corrects the pattern data such that the slope of the line segment that links the center point 202 of the embroidery pattern 200 to the point 203 matches the slope of the line segment that links the first center point 111 and the second center point 112 of the indicator mark 110 in the embroidery coordinate system. The CPU 61 acquires the corrected pattern data as the embroidery data (Step S76).

The CPU 61 waits until a command to start sewing is input (NO at Step S77). The command to start sewing may be input by user, using one of a panel operation and the operation switches 21. In a case where the command to start sewing has been input (YES at Step S77), the CPU 61 performs processing that sews the embroidery pattern 200 on the sewing workpiece 5 in accordance with the embroidery data that were acquired at Step S76 (Step S78). More specifically, the CPU 61 causes the embroidery device 2 to move the embroidery frame 53 by driving the X axis motor 82 and the Y axis motor 83 (refer to FIG. 4) in accordance with the embroidery data. By driving the sewing machine motor 79 to drive the needle bar up-and-down moving mechanism 84 in coordination with the moving of the embroidery frame 53, the CPU 61 moves the needle bar 29, on which the sewing needle 28 is mounted, up and down, thus sewing the embroidery pattern 200 on the sewing workpiece 5 that is clamped in the embroidery frame 53. When the sewing of the embroidery pattern 200 is finished, the CPU 61 terminates the second processing.

According to the sewing machine system 100 that is described above, the portable terminal 3 is able to compute the positioning data based on the image data that were created by the processing at Step S32 in FIG. 9. Therefore, in the portable terminal 3, it is possible to compute, by using the image data, the positioning data for the indicator mark 110 on the sewing workpiece 5, which heretofore could only be done by a known sewing machine that is provided with an image capture device. The sewing machine 1 is able to set at least one of the sewing position and the sewing angle of the embroidery pattern b using the output positioning data. The sewing machine 1 and the portable terminal 3 can communicate through the network 9. Therefore, the operation when the portable terminal 3 outputs data to the sewing machine 1 is simpler than in a case where the sewing machine 1 and the portable terminal 3 are connectable by a cable.

The sewing machine 1 transmits the pattern size to the portable terminal 3 for the convenience of the user. The portable terminal 3 is able to determine, based on the positioning data and the pattern size, whether or not the embroidery pattern will fit within the sewing area 45 in a case where the embroidery pattern is positioned according to the positioning that was set based on the positioning data. Depending on the pattern size and the positioning of the indicator mark 110, if the positioning of the embroidery pattern is set based on the positioning data that were computed by the portable terminal 3, cases may occur in which the embroidery pattern does not fit within the sewing area 45. In this sort of case, if the portable terminal 3 simply outputs the positioning data to the sewing machine 1, and if the sewing machine 1 sets the positioning of the embroidery pattern based on the positioning data that were output, the user must check the result of the positioning in the sewing machine 1, and then perform an operation to position the embroidery pattern within the sewing area 45. In contrast to this, in the sewing machine system 100 of the present embodiment, if the sewing machine 1 sets the positioning of the embroidery pattern based on the positioning data that were acquired by the portable terminal 3, the embroidery pattern will definitely fit within the sewing area 45. Therefore, in the process in which the sewing machine 1 sets the positioning of the embroidery pattern based on the positioning data and forms the stitches that make up the embroidery pattern, the number of times that the user repeatedly performs operations of the sewing machine 1 and the portable terminal 3 can be kept to a minimum. In other words, it is possible to make the sewing machine 1 capable of easily setting the positioning of the embroidery pattern on the sewing workpiece 5, without making the configuration of the sewing machine 1 more complex. Furthermore, in a case where the portable terminal 3 has determined that the embroidery pattern cannot be positioned within the sewing area 45 based on the computed positioning data, information to that effect is displayed on the display portion 135. Based on that notification, the user can take measures such as changing the positioning of the indicator mark 110 on the sewing workpiece 5, changing the positioning of the sewing workpiece 5 in relation to the embroidery frame 53, or the like, and then performing image capture again.

With the known sewing machine that is provided with an image capture device that has an image capture range that is smaller than the sewing area 45 in the embroidery frame 53, cases occur in which the CPU must divide the entire sewing area 45 into a plurality of blocks, then perform processing that detects the indicator mark 110 by successively moving the embroidery frame 53 to positions that correspond to the individual blocks. In contrast to this, the portable terminal 3 in the present embodiment is a separate unit from the sewing machine 1. When the portable terminal 3 creates the image data, there is no restriction on the image capture range. For example, the portable terminal 3 is able to create the image data by capturing a single image that includes both the reference marks 150 and the indicator mark 110 that is positioned in the area within the embroidery frame 53 in a state in which the embroidery frame 53 has been removed from the embroidery device 2. Furthermore, by capturing an image of the embroidery frame 53 in a state in which the embroidery frame 53 has been removed from the embroidery device 2, the portable terminal 3 is able to create the image data in a state in which elements of the sewing machine 1 (for example, the needle bar 29 and the presser foot 30) are not included in the image capture range. The portable terminal 3 is able to make the processing that detects the indicator mark 110 based on the image data simpler than it would be in a case where the elements of the sewing machine are included in the image capture range.

On the other hand, there are some cases in which the user wants to perform the image capture in a state in which the embroidery frame 53 is mounted on the embroidery device 2, and to compute the positioning data based on the image data for the captured image. In a case where the embroidery frame 53 is mounted on the embroidery device 2 before the positioning data are acquired, the sewing machine 1 can move the embroidery frame 53 to the image capture position automatically. In the present embodiment, the user is able to select one of the three image capture positions by operating the portable terminal 3. In a case where an image is captured of the area within the embroidery frame 53 in a state in which the embroidery frame 53 is mounted on the embroidery device 2, it is sometimes impossible to fit the entire area within the embroidery frame 53 into the image capture range, depending on the type of the embroidery frame 53. The sewing machine 1 is able to determine automatically which of the reference marks 150 to use as reference positions for computing the positioning of the indicator mark 110, according to which of the reference marks 150 among the plurality of the reference marks 150 are included in the captured image. The selected one of the plurality of types of the embroidery frame 53 can be mounted on the embroidery device 2. Based on the result of the detection of the type of the embroidery frame 53, the sewing machine 1 can automatically move the embroidery frame 53 to the image capture position that corresponds to the type of the embroidery frame 53. The sewing machine 1 is therefore able to improve the convenience for the user in a case where an image is captured in a state in which the embroidery frame 53 is mounted on the embroidery device 2.

The sewing machine 1 performs the processing at Steps S67 and S72 in FIG. 12. Based on the message that is displayed on the LCD 15, the user is able to understand which one of the portable terminal 3 and the sewing machine 1 should be operated. The sewing machine 1 is able to make the operating procedure for the user to sew the embroidery pattern more clearly understandable than in a case where the user is not notified that the sewing machine 1 is in a state of waiting for the acquisition of the positioning data.

Based on the captured image, the portable terminal 3 can detect the reference marks 150, the indicator mark 110, and the type mark 160, can automatically determine the type of the embroidery frame 53 and the orientation of the embroidery frame 53 in the captured image, and can compute the positioning data. Therefore, the user does not need to consider the orientation of the embroidery frame 53 in the captured image when the image capture is performed. The user also does not need to input information to the portable terminal 3 in order to specify the orientation of the embroidery frame 53 in the captured image. The portable terminal 3 can reliably avoid a situation in which the positioning data cannot be computed properly because the correspondence relationship between the orientation of the embroidery frame 53 in the captured image and the direction in which the embroidery frame 53 is mounted on the embroidery device 2 has not been set properly.

The embroidery device 2 of the present embodiment is configured such that the selected one of the plurality of types of the embroidery frames 53 can be mounted thereon. The size and the shape of the embroidery frame 53 vary according to the type of the embroidery frame 53. According to the processing at Step S65, the sewing machine 1 can automatically detect the type of the embroidery frame 53 and can transmit to the portable terminal 3 the frame data that describe the type of the embroidery frame 53. The portable terminal 3, having received the frame data, can specify the type of the embroidery frame 53 merely by performing the processing that receives the frame data, which is simpler than specifying the type of the embroidery frame 53 based on the type mark 160.

The portable terminal 3 can notify the user that at least one of the reference marks 150, the type mark 160, and the indicator mark 110 has not been detected. Based on the notification, the user can respond by performing the image capture again or the like. The portable terminal 3 is able to make the acquiring of the positioning data more convenient for the user than it would be in a case where the user is not notified that at least one of the reference marks 150, the type mark 160, and the indicator mark 110 has not been detected.

Various types of modifications may be made to the sewing machine 1 in the embodiment that is described above. For example, at least one of the modifications in the examples (A) to (E) that are described below may be applied as desired.

(A) The configuration of the sewing machine 1 may be modified as desired. The sewing machine 1 may be a different type of sewing machine, such as an industrial sewing machine, a multi-needle sewing machine, or the like, for example. The sewing machine may also be a sewing machine that is configured as an integrated unit with the embroidery device, for example. Instead of being stored in the flash ROM 64, the pattern data for the embroidery pattern may be stored in another storage device in the sewing machine 1 (for example, the ROM 62). In a case where the sewing machine 1 includes a structural element to which a storage medium such as a memory card or the like can be connected, the sewing machine 1 may acquire pattern data that are stored in the storage medium and store the pattern data in a storage device of the sewing machine 1 (for example, the flash ROM 64). In a case where the sewing machine 1 includes a structural element to which an external device can be connected, either by wire or wirelessly, the sewing machine 1 may acquire pattern data that are stored in the external device and store the pattern data in a storage device. The sewing workpiece may be any object in which a stitch can be formed. The positioning data may be computed by an image capture unit that is provided with an image capture device, based on image data.

The device that is provided with the image capture device may be a device other than the portable terminal 3, such as a mobile telephone that is not a smartphone, a digital camera that is provided with a computation function, or the like, for example. The image capture device may be any device, such as a CCD camera or the like, that is capable of capturing an image and outputting image data for the captured image. The structure of the embroidery frame, such as its shape, size, or the like, may be modified as desired. For example, the embroidery frame may be such that the clamping portion of the embroidery frame includes an upper frame (the first frame) and a lower frame (the second frame) and that the upper frame and the lower frame are configured to clamp the sewing workpiece from above and below. In that case, in a state in which the sewing workpiece is clamped, the visible position on the side that faces the needle bar of the sewing machine is on the top face of the upper frame.

(B) The configurations of the various types of marks (the indicator mark 110, the reference marks 150, and the type mark 160) may each be modified as desired. For example, at least one of the size, the material, the design, and the color of a mark may be modified. The characteristic points of the marks that are used in the processing that is described above may be modified as desired. In a case where the marks that are described above include line segments that intersect one another, for example, the CPU 121 may identify a point of intersection as a characteristic point. The CPU 121 may also identify an endpoint of a line segment as a characteristic point.

The number of the indicator marks 110 and the number of the characteristic points that any one indicator mark 110 contains can be modified as desired. In a case where the positioning of the embroidery pattern is specified based on a plurality of the indicator marks 110, the positioning of the embroidery pattern, particularly the angle of the embroidery pattern, can be set with greater precision than in a case where the positioning of the embroidery pattern is specified based on one indicator mark 110. It is acceptable for the CPU 121 to detect at least one of the position and the angle of the indicator mark 110 as the positioning of the indicator mark 110, based on the image data. The characteristic points for specifying the positioning of the indicator mark 110 (in the embodiment that is described above, the first center point 111 and the second center point 112 of the indicator mark 110) and the method for computing the positioning may be modified as desired, taking into account the structure and the like of the indicator mark 110.

In the same manner, the number of the reference marks 150 and the number of the characteristic points that any one reference mark 150 contains can be modified as desired. For example, in a case where one reference mark includes a plurality of characteristic points, it is acceptable for only one reference mark to be provided. In a case where the CPU 121 performs keystone correction based on the characteristic points of the reference marks, as in the embodiment that is described above, it is preferable for there to be at least one reference mark and a total of at least four characteristic points included in the at least one reference mark. In a case where only one type of the embroidery frame 53 can be mounted on the embroidery device 2, in a case where the user inputs the type of the embroidery frame 53 to the portable terminal 3, and the like, it is acceptable for the type mark 160 not to be provided on the embroidery frame 53. The number of the type marks 160 and the number of the characteristic points that the type marks 160 contain can be modified as desired.

(C) The structure of the pattern data and the embroidery data and the methods for creating the pattern data and the embroidery data, may be modified as desired. For example, in a case where the embroidery pattern is a pattern to be sewn in a plurality of colors, the pattern data and the embroidery data may include thread color data. The thread color data indicate the colors of the threads that will form the stitches. The setting of the coordinates in the embroidery coordinate system may be determined in advance and may be modified as desired. The coordinate system for the coordinates that are indicated by the positioning data that are computed based on the image data may be different from the embroidery coordinate system, as long as the coordinates can be converted between the two systems. In that case, the sewing machine 1 may perform processing that converts the positioning data into data for the embroidery coordinate system.

(D) The program that contains the instructions for performing the first processing in FIG. 8, and the data for the first processing, may be stored in a storage device in the portable terminal 3 by the time the portable terminal 3 executes the program. The program that contains the instructions for performing the second processing in FIG. 12, and the data for the second processing, may be stored in a storage device in the sewing machine 1 by the time the sewing machine 1 executes the program. Therefore, the method for acquiring the program and the pattern data, the route by which the program and the pattern data are acquired, and the device that stores the program may each be modified as desired. The programs that the processors of the portable terminal 3 and the sewing machine 1 execute, as well as the pattern data, may be received from another device through a cable or by wireless communication and may be stored in a storage device such as a flash memory or the like. The other device may be one of a PC and a server that is connected through a network.

(E) The individual steps of the first processing in FIG. 8 may not necessarily be performed by the CPU 121, and some or all of the steps may be performed by another electronic device (for example, an ASIC). The individual steps of the first processing may also be performed through distributed processing by a plurality of electronic devices (for example a plurality of CPUs). The order of the individual steps of the first processing in the embodiment that is described above may also be modified as necessary, and steps may also be omitted and added. Furthermore, based on a command from the CPU 121, the operating system (OS) or the like that is running in the portable terminal 3 may perform some or all of the actual processing, and a case in which the functions of the embodiment that is described above are implemented by that processing is included within the scope of the present disclosure. In the same manner, the individual steps of the second processing in FIG. 12 may not necessarily be performed by the CPU 61, and some or all of the steps may be performed by another electronic device (for example, an ASIC). The individual steps of the second processing may also be performed through distributed processing by a plurality of electronic devices (for example a plurality of CPUs). The order of the individual steps of the second processing in the embodiment that is described above may also be modified as necessary, and steps may also be omitted and added. Furthermore, based on a command from the CPU 61, the operating system (OS) or the like that is running in the sewing machine 1 may perform some or all of the actual processing, and the functions of the embodiment that is described above may be implemented by that processing. For example, at least one of the modifications in the examples (E-1) to (E-6) that are described below may be applied as desired.

(E-1) In a case where only one type of the embroidery frame 53 can be mounted in the sewing machine 1, in a case where the user inputs the type of the embroidery frame 53, and the like, the processing from Step S36 to Step S40 in FIG. 9 may be omitted. Furthermore, the processing at Step S37 may also be performed regardless of whether or not the frame data were received at Step S36.

(E-2) In a case where the orientation of the embroidery frame 53 in the captured image is fixed, the portable terminal 3 may omit the processing at Step S42 in FIG. 9 for specifying the orientation of the embroidery frame 53 in the captured image. In that case, the portable terminal 3 may associate each one of the plurality of the characteristic points that are included in the reference marks 150 in the captured image with the corresponding relative position according to predetermined relationships, for example. Specifically, in a case where the up-down direction and the left-right direction in the image that is shown in FIG. 10 respectively correspond to the front-rear direction and the left-right direction of the embroidery frame 53, the portable terminal 3 may associate the characteristic points in the upper left, the upper right, the lower right, and the lower left of the image with the relative positions of the characteristic points P1 to P4, respectively. It is not necessary for the CPU 121 to specify the orientation of the embroidery frame 53 in the image based on the positioning of the type mark 160. For example, in a case where the reference mark 150 has directionality, such as in a case where the reference mark 150 is the same sort of mark as the indicator mark 110, for example, the CPU 121 may specify the orientation of the embroidery frame 53 in the image based on the orientation that is indicated by the reference mark 150.

(E-3) Some or all of the processing at Steps S7, S11, and S12 in FIG. 8 can be omitted as necessary. In the same manner, some or all of the processing at Steps S35, S39, S46, and S51 in FIG. 9 can be omitted as necessary. Some or all of the processing at Steps S67, S72, and S74 in FIG. 12 can be omitted as necessary. At each of the steps cited above, the notification may be provided by audio instead of by the processing that displays the error message.

(E-4) In a case where the image is captured in a state in which the embroidery frame 53 is mounted on the embroidery device 2, the embroidery frame 53 may be moved to an image capture position that is set in advance. The embroidery frame 53 may be moved based on a command that the user has input directly to the sewing machine 1. The processing that moves the embroidery frame 53 to the image capture position may be omitted as necessary. The amount of movement from the initial position to the image capture position may also be the same, irrespective of the type of the embroidery frame 53. The image capture position may also be set to any position that is suitable for image capture.

(E-5) The CPU 61 of the sewing machine 1 may set one of the position and the angle of the embroidery pattern based on the positioning data. For example, in a case where the CPU 61 sets the position of the embroidery pattern based on the positioning data, the CPU 61 may set the angle of the embroidery pattern to an initial angle. The reference to be used when the CPU 61 sets one of the position and the angle of the embroidery pattern based on the positioning data may be set in advance, and may be modified as desired. Any known method may be used as the method for computing the positioning data, and the method is not limited to the method that was explained in the embodiment that is described above.

(E-6) The size of the embroidery pattern is not limited to the size of the smallest rectangle in which the embroidery pattern can be contained. For example, the size of the embroidery pattern may also be represented in terms of the diameter of the smallest circle in which the embroidery pattern can be contained. In that case, in the processing at Step S50 in FIG. 9, where the smallest circle in which the embroidery pattern can be contained fits entirely within the sewing area 45, the CPU 121 may determine that the embroidery pattern fits within the sewing area 45.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

an embroidery frame moving portion that is configured to move an embroidery frame in a movement direction;

a sewing portion that is configured to form a stitch in a sewing workpiece that is clamped in the embroidery frame;

a communication portion that is configured to perform transmission and receiving of data to and from an external device;

a processor; and a memory that is configured to store computer-readable instructions that, when executed by the processor, cause the processor to perform the steps of:

specifying an embroidery pattern to be formed in the sewing workpiece that is clamped in the embroidery frame, and a size of the embroidery pattern, outputting the size of the embroidery pattern through the communication portion to a device that is provided with an image capture portion, providing notification, from the time of the outputting of the size of the embroidery pattern to the device until a time of acquiring of positioning data, that the sewing machine is in a state of waiting for the acquiring of the positioning data, acquiring the positioning data through the communication portion, the positioning data being data that the device has computed based on image data for an image that has been captured of a range that includes at least one reference mark and at least one indicator mark, the positioning data indicating at least one of a position and an angle of the at least one indicator mark in relation to the at least one reference mark, the at least one reference mark being provided on the embroidery frame, the at least one indicator mark being positioned in an area inside the embroidery frame on the sewing workpiece that is clamped in the embroidery frame, the positioning data being output from the device to the sewing machine in response to determining by the device that the embroidery pattern can be positioned in a sewing area in a case where at least one of a position and an angle of the embroidery pattern on the sewing workpiece is set based on the size of the embroidery pattern and on the positioning data, the sewing area being an area that is set inside the embroidery frame, setting at least one of the position and the angle of the embroidery pattern on the sewing workpiece, based on the positioning data, acquiring embroidery data, the embroidery data being data for forming stitches that make up the embroidery pattern at at least one of the position and the angle of the embroidery pattern on the sewing workpiece that has been set, and causing the embroidery frame moving portion and the sewing portion to form the stitches that make up the embroidery pattern on the sewing workpiece, based on the embroidery data.

2. A sewing machine, comprising:

an embroidery frame moving portion that is configured to move an embroidery frame in a movement direction;

a sewing portion that is configured to form a stitch in a sewing workpiece that is clamped in the embroidery frame;

a communication portion that is configured to perform transmission and receiving of data to and from an external device;

a detection portion that is configured to detect whether the embroidery frame has been mounted on the embroidery frame moving portion;

a processor; and a memory that is configured to store computer-readable instructions that, when executed by the processor, cause the processor to perform the steps of:

specifying an embroidery pattern to be formed in the sewing workpiece that is clamped in the embroidery frame, and a size of the embroidery pattern, outputting the size of the embroidery pattern through the communication portion to a device that is provided with an image capture portion, causing the embroidery frame moving portion to move the embroidery frame to an image capture position, in response to detecting by the detection portion that the embroidery frame has been mounted on the embroidery frame moving portion before acquiring of positioning data, acquiring the positioning data through the communication portion, the positioning data being data that the device has computed based on image data for an image that has been captured of a range that includes at least one reference mark and at least one indicator mark, the positioning data indicating at least one of a position and an angle of the at least one indicator mark in relation to the at least one reference mark, the at least one reference mark being provided on the embroidery frame, the at least one indicator mark being positioned in an area inside the embroidery frame on the sewing workpiece that is clamped in the embroidery frame, the positioning data being output from the device to the sewing machine in response to determining by the device that the embroidery pattern can be positioned in a sewing area in a case where at least one of a position and an angle of the embroidery pattern on the sewing workpiece is set based on the size of the embroidery pattern and on the positioning data, the sewing area being an area that is set inside the embroidery frame, setting at least one of the position and the angle of the embroidery pattern on the sewing workpiece, based on the positioning data, acquiring embroidery data, the embroidery data being data for forming stitches that make up the embroidery pattern at at least one of the position and the angle of the embroidery pattern on the sewing workpiece that has been set, and causing the embroidery frame moving portion and the sewing portion to form the stitches that make up the embroidery pattern on the sewing workpiece, based on the embroidery data.

3. The sewing machine according to claim 2, wherein the detection portion is further configured to detect a type of the embroidery frame in a case where the embroidery frame has been mounted on the embroidery frame moving portion, and the causing of the embroidery frame moving portion to move the embroidery frame to the image capture position includes causing the embroidery frame moving portion to move the embroidery frame to the image capture position that corresponds to the detected type of the embroidery frame, in response to detecting by the detection portion that the embroidery frame has been mounted on the embroidery frame moving portion before the acquiring of the positioning data.

4. A non-transitory computer-readable medium that stores computer-readable instructions that, when executed by a processor of a sewing machine that includes an embroidery frame moving portion that is configured to move an embroidery frame in a moving direction, a sewing portion that is configured to form a stitch in a sewing workpiece that is clamped in the embroidery frame, and a communication portion that is configured to perform transmission and receiving of data to and from an external device, cause the processor to perform the steps of:

specifying an embroidery pattern to be formed in the sewing workpiece that is clamped in the embroidery frame, and a size of the embroidery pattern;

outputting the size of the embroidery pattern through the communication portion to a device that is provided with an image capture portion, providing notification, from the time of the outputting of the size of the embroidery pattern to the device until the time of the acquiring of the positioning data, that the sewing machine is in a state of waiting for the acquiring of the positioning data, acquiring the positioning data through the communication portion, the positioning data being data that the device has computed based on image data for an image that has been captured of a range that includes at least one reference mark and at least one indicator mark, the positioning data indicating at least one of a position and an angle of the at least one indicator mark in relation to the at least one reference mark, the at least one reference mark being provided on the embroidery frame, the at least one indicator mark being positioned in an area inside the embroidery frame on the sewing workpiece that is clamped in the embroidery frame, the positioning data being output from the device to the sewing machine in response to determining by the device that the embroidery pattern can be positioned in a sewing area in a case where at least one of a position and an angle of the embroidery pattern on the sewing workpiece is set based on the size of the embroidery pattern and on the positioning data, the sewing area being an area that is set inside the embroidery frame, setting at least one of the position and the angle of the embroidery pattern on the sewing workpiece, based on the positioning data, acquiring embroidery data, the embroidery data being data for forming stitches that make up the embroidery pattern at at least one of the position and the angle of the embroidery pattern on the sewing workpiece that has been set, and causing the embroidery frame moving portion and the sewing portion to form the stitches that make up the embroidery pattern on the sewing workpiece, based on the embroidery data.

5. A non-transitory computer-readable medium that stores computer-readable instructions that, when executed by a processor of a sewing machine that includes an embroidery frame moving portion that is configured to move an embroidery frame in a moving direction, a sewing portion that is configured to form a stitch in a sewing workpiece that is clamped in the embroidery frame, a communication portion that is configured to perform transmission and receiving of data to and from an external device, and a detection portion that is configured to detect whether the embroidery frame has been mounted on the embroidery frame moving portion, cause the processor to perform the steps of:

specifying an embroidery pattern to be formed in the sewing workpiece that is clamped in the embroidery frame, and a size of the embroidery pattern, outputting the size of the embroidery pattern through the communication portion to a device that is provided with an image capture portion, causing the embroidery frame moving portion to move the embroidery frame to an image capture position, in response to detecting by the detection portion that the embroidery frame has been mounted on the embroidery frame moving portion before the acquiring of the positioning data, acquiring positioning data through the communication portion, the positioning data being data that the device has computed based on image data for an image that has been captured of a range that includes at least one reference mark and at least one indicator mark, the positioning data indicating at least one of a position and an angle of the at least one indicator mark in relation to the at least one reference mark, the at least one reference mark being provided on the embroidery frame, the at least one indicator mark being positioned in an area inside the embroidery frame on the sewing workpiece that is clamped in the embroidery frame, the positioning data being output from the device to the sewing machine in response to determining by the device that the embroidery pattern can be positioned in a sewing area in a case where at least one of a position and an angle of the embroidery pattern on the sewing workpiece is set based on the size of the embroidery pattern and on the positioning data, the sewing area being an area that is set inside the embroidery frame, setting at least one of the position and the angle of the embroidery pattern on the sewing workpiece, based on the positioning data, acquiring embroidery data, the embroidery data being data for forming stitches that make up the embroidery pattern at at least one of the position and the angle of the embroidery pattern on the sewing workpiece that has been set, and causing the embroidery frame moving portion and the sewing portion to form the stitches that make up the embroidery pattern on the sewing workpiece, based on the embroidery data.

6. The non-transitory computer-readable medium according to claim 5, wherein the detection portion is further configured to detect a type of the embroidery frame in a case where the embroidery frame has been mounted on the embroidery frame moving portion, and the causing of the embroidery frame moving portion to move the embroidery frame to the image capture position includes causing the embroidery frame moving portion to move the embroidery frame to the image capture position that corresponds to the detected type of the embroidery frame, in response to detecting by the detection portion that the embroidery frame has been mounted on the embroidery frame moving portion before the acquiring of the positioning data.

7. A sewing machine system, comprising:

a sewing machine;

an embroidery frame; and a device, wherein the sewing machine includes:

an embroidery frame moving portion that is configured to be removably mounted with the embroidery frame and to move the embroidery frame in a movement direction;

a sewing portion that is configured to form a stitch in a sewing workpiece that is clamped in the embroidery frame, the sewing portion including a needle bar;

a first communication portion that is configured to perform transmission and receiving of data to and from an external device;

a first processor; and a first memory that is configured to store computer-readable instructions that, when executed by the first processor, cause the first processor to perform the steps of:

specifying an embroidery pattern to be formed in the sewing workpiece that is clamped in the embroidery frame, and a size of the embroidery pattern, outputting the size of the embroidery pattern to the device through the first communication portion, acquiring, through the first communication portion, positioning data that has been output from the device, the positioning data being data that the device has computed based on image data for an image that has been captured of a range that includes at least one reference mark and at least one indicator mark, the positioning data indicating at least one of a position and an angle of the at least one indicator mark in relation to the at least one reference mark, the at least one reference mark being provided on the embroidery frame, the at least one indicator mark being positioned in an area inside the embroidery frame on the sewing workpiece that is clamped in the embroidery frame, setting at least one of the position and the angle of the embroidery pattern on the sewing workpiece, based on the positioning data, acquiring embroidery data, the embroidery data being data for forming stitches that make up the embroidery pattern at at least one of the position and the angle of the embroidery pattern on the sewing workpiece that has been set, and causing the embroidery frame moving portion and the sewing portion to form the stitches that make up the embroidery pattern on the sewing workpiece, based on the embroidery data, the embroidery frame includes:

a mounting portion that is configured to be mounted on and removed from the embroidery frame moving portion; and a clamping portion that includes a first frame and a second frame, the first frame and the second frame being configured to clamp the sewing workpiece, the clamping portion having the at least one reference mark that is disposed at a visible position on a side of the clamping portion that is opposite the needle bar in a state in which the sewing workpiece is clamped, and the device includes:

an image capture portion that is configured to create image data;

a second communication portion that is configured to perform transmission and receiving of data to and from an external device;

a second processor; and a second memory that is configured to store computer-readable instructions that, when executed by the second processor, cause the second processor to perform the steps of:

causing the image capture portion to capture the image of the range that includes the at least one reference mark and the at least one indicator mark, and to create the image data for the image, acquiring, through the second communication portion, the size of the embroidery pattern that has been output from the sewing machine, computing the positioning data based on the image data, determining whether the embroidery pattern can be positioned in a sewing area in a case where at least one of the position and the angle of the embroidery pattern on the sewing workpiece is set based on the positioning data and the size of the embroidery pattern, the sewing area being an area that is set inside the embroidery frame, and outputting the positioning data to the sewing machine through the second communication portion, in response to determining that the embroidery pattern can be positioned in the sewing area.

8. The sewing machine system according to claim 7, wherein the computer-readable instructions further cause the second processor to perform the step of: providing notification that the embroidery pattern cannot be positioned in the sewing area, in response to determining that the embroidery pattern cannot be positioned in the sewing area.

* * * * *